US010604307B2

(12) United States Patent
Stahlecker

(10) Patent No.: US 10,604,307 B2
(45) Date of Patent: Mar. 31, 2020

(54) LID FOR A BEVERAGE CUP, CUP ASSEMBLY, AND METHOD FOR MANUFACTURING A LID

(71) Applicant: Werner Stahlecker, Goeppingen (DE)

(72) Inventor: Werner Stahlecker, Goeppingen (DE)

(73) Assignee: PTM PACKAGING TOOLS MACHINERY PTE. LTD., Singapore (SG)

( * ) Notice: Subject to any disclaimer, the term of this patent is extended or adjusted under 35 U.S.C. 154(b) by 172 days.

(21) Appl. No.: 14/862,501

(22) Filed: Sep. 23, 2015

(65) Prior Publication Data

US 2016/0083151 A1 Mar. 24, 2016
US 2017/0152079 A9 Jun. 1, 2017

(30) Foreign Application Priority Data

Sep. 24, 2014 (DE) ..... 10 2014 219 272

(51) Int. Cl.
*B65D 43/06* (2006.01)
*B65D 43/02* (2006.01)

(52) U.S. Cl.
CPC ..... *B65D 43/065* (2013.01); *B65D 43/0212* (2013.01); *B65D 43/0222* (2013.01); *B65D 2543/0024* (2013.01); *B65D 2543/00027* (2013.01); *B65D 2543/00046* (2013.01); *B65D 2543/00092* (2013.01); *B65D 2543/00101* (2013.01); *B65D 2543/00268* (2013.01); *B65D 2543/00296* (2013.01); *B65D 2543/00351* (2013.01); *B65D 2543/00527* (2013.01); *B65D 2543/00537* (2013.01); *B65D 2543/00638* (2013.01); *B65D 2543/00685* (2013.01);
(Continued)

(58) Field of Classification Search
CPC ..... B65D 43/065; B65D 43/0222; B65D 43/0212; B65D 2543/00268
USPC ..... 220/713, 780; 229/404, 906.1; 215/317, 215/321
See application file for complete search history.

(56) References Cited

U.S. PATENT DOCUMENTS 1,343,724 A * 6/1920 Hulbert ..... B65D 43/022 229/5.6
1,482,761 A * 2/1924 Moore ..... B65D 3/06 229/5.6
(Continued)

FOREIGN PATENT DOCUMENTS

CN 201140842 Y 10/2008
DE 83 21 808.4 U1 12/1983
(Continued)

OTHER PUBLICATIONS

European Search Report issued in Appln. No. 15182881.1 dated Feb. 9, 2016 with English translation of Category of Cited Documents (8 pages).
(Continued)

*Primary Examiner* — James N Smalley
(74) *Attorney, Agent, or Firm* — Flynn Thiel, P.C.

(57) ABSTRACT

A lid made from a paper material or a paper-like material for a beverage cup, which lid is constructed from a lid-plate element and a wall element and which offers below a lid plate which is formed by the lid-plate element a space for receiving components of a beverage which protrude beyond the cup.

7 Claims, 37 Drawing Sheets

(52) U.S. Cl.
CPC ..... *B65D 2543/00731* (2013.01); *B65D 2543/00796* (2013.01); *B65D 2543/00805* (2013.01)

(56) References Cited

U.S. PATENT DOCUMENTS

| | | | | | |
|---|---|---|---|---|---|
| 1,627,047 | A * | 5/1927 | Moore | B65D 3/06 229/125.17 |
| 2,069,213 | A | 2/1937 | Carew | |
| 2,233,489 | A * | 3/1941 | Reifsnyder | B65D 43/0212 229/5.5 |
| 2,487,519 | A * | 11/1949 | Brow | B65D 41/18 215/321 |
| 2,493,086 | A | 1/1950 | Reifsnyder | |
| 2,721,686 | A * | 10/1955 | Reifsnyder | A47J 36/06 229/125.25 |
| 2,723,072 | A * | 11/1955 | Sayford, Jr. | B65D 21/0222 229/404 |
| 2,787,410 | A * | 4/1957 | Moore | B65D 43/021 229/125.13 |
| 6,220,476 | B1 * | 4/2001 | Waller | A47G 19/2272 220/713 |
| 6,824,003 | B1 | 11/2004 | Wong | |
| 2006/0226147 | A1 * | 10/2006 | Phillips | A47G 21/106 220/254.2 |
| 2008/0099481 | A1 * | 5/2008 | D'Amato | B65D 43/0262 220/276 |
| 2010/0243722 | A1 * | 9/2010 | Hyder | B65D 43/0208 229/125.02 |
| 2013/0334227 | A1 | 12/2013 | Stahlecker | |
| 2013/0334228 | A1 * | 12/2013 | Schmidtner | B65D 45/32 220/319 |
| 2014/0054306 | A1 | 2/2014 | Panek et al. | |
| 2014/0144923 | A1 | 5/2014 | Panek et al. | |
| 2015/0251821 | A1 | 9/2015 | Stahlecker | |

FOREIGN PATENT DOCUMENTS

| | | | |
|---|---|---|---|
| EP | 2 592 014 | A1 | 5/2013 |
| EP | 2 674 370 | A1 | 12/2013 |
| EP | 2674370 | A1 | 12/2013 |
| JP | S53137785 | A | 12/1978 |
| JP | H0420302 | A | 1/1992 |
| JP | 2007230643 | A | 9/2007 |
| WO | WO 2004/048208 | A2 | 6/2004 |
| WO | WO 2008/104019 | A1 | 9/2008 |
| WO | WO 2012/094801 | A1 | 7/2012 |

OTHER PUBLICATIONS

European Office Action issued in Appln. No. 15182881.1 dated Jun. 14, 2017 (7 pages).

European Office Action issued in EP 15182881.1 dated Feb. 1, 2018 (6 pages).

First Chinese Office Action issued in Application No. 201510614695.7 dated Mar. 23, 2018 with English translation (18 pages).

Japanese Office Action with English translation issued in corresponding Application No. 2015-176281 dated May 21, 2019.

* cited by examiner

LID FOR A BEVERAGE CUP, CUP ASSEMBLY, AND METHOD FOR MANUFACTURING A LID

CROSS-REFERENCE TO RELATED APPLICATIONS

This claims priority from German Patent Application No. 10 2014 219 272.2, filed on Sep. 24, 2014, the disclosure of which is hereby incorporated by reference into this application in its entirety.

FIELD OF THE INVENTION

The invention relates to a lid, from a paper material or a paper-like material, for a beverage cup, a cup assembly having a cup and a lid, and to a method for manufacturing a lid.

BACKGROUND OF THE INVENTION

Lids for beverage cups have proven successful in the single-use field, for example, in particular in the food-service industry, for avoiding inadvertent spilling of beverages while enabling drinking by way of a drinking aperture in the lid. Lids of this type are often composed of plastics; however, in the meantime lids made from sustainable raw materials, such as paper, for example, are also being more widely used. It is a common feature of known lids from paper material that a lid plate bears on a rolled lip rim of a cup, so that the lid when pressed onto a cup bears on the rolled lip rim thereof and thus can no longer shift out of place. Such an embodiment suffices for most applications. This applies in particular if and when the cup is filled with a commonplace beverage, such as a carbonated soft drink or a hot beverage, such as coffee, for example.

However, known lids from paper material are not suitable for beverages which completely protrude beyond the rolled lip rim. This is the case, for example, with a cappuccino which is provided with milk foam on the top. However, it would be desirable to be able to close a cup from paper material or paper-like material with a lid also in the case of beverages of this type.

Paper material or paper-like material is considered to be paper, cardboard, or paperboard, for example. Paper, cardboard, or paperboard may be available in planar segments, for example, and these planar segments may then be wound to form a sleeve having an encircling wall or else shaped to form a lid element which is cup-shaped, for example. The paper material is expediently coated so as to be liquid-tight. However, plastics material which is available in a planar manner, for example, is also considered to be paper-like material, if and when said plastics material is processed in the same way or at least in a similar way as paper material to form a cup or a lid. Laminated plastics, for example, are also planar plastics materials. In order for a cup or a lid to be manufactured, the planar plastics material which is available in the form of segments is likewise wound around a mandrel and connected in the region of the overlap, so as to shape a sleeve which in particular is conical. A cup-shaped base or a cup-shaped lid element may also be shaped from the planar plastics material, in that a circular blank in its peripheral region is folded upwards in a slightly vertical manner in relation to a base area. However, the issues which arise in plastics material which are to be processed in a paper-like manner are substantially the same as those which arise when processing paper material. The present invention may be employed for plastics materials which are to be processed in a paper-like manner, but said invention is not particularly configured for plastics materials which are to be processed in a paper-like manner but may of course also be very advantageously employed for paper material.

SUMMARY OF THE INVENTION

It is an object of the invention to provide a lid from paper material or paper-like material, by way of which additional space is created above the cup periphery. It is furthermore an object of the invention to provide a cup assembly having a cup and such a lid. It is furthermore an object of the invention to provide a method for manufacturing such a lid.

The invention relates to a lid from a paper material or a paper-like material for a beverage cup, having a lid-plate element and a wall element;

wherein the lid-plate element configures a lid plate, in particular a planar lid plate, and the wall element configures an encircling wall;

wherein the lid has a receptacle, encircling a central axis, for a rolled lip rim of the beverage cup; and wherein the lid plate and the encircling wall are interconnected in such a manner that the lid plate is kept at a spacing above the receptacle.

In the lid according to the invention the encircling wall is used as a supporting element for the lid plate, such that the lid plate may be disposed so as to be significantly above the rolled lip rim or above the cup periphery, respectively. This enables free space to be provided above the rolled lip rim, in which milk foam of a cappuccino may be received, for example. As a result, coffee specialties such as cappuccino, for example, may be offered also in the field of single-use cups such as are used in particular in the food-service industry, while nevertheless achieving the safety which is connected with a lid. Paper material or paper-like material is printable, offering high quality and at the same time low costs, for example by screen printing. The lid according to the invention is advantageously readily stackable, readily de-stackable, and has a drinking aperture and optionally a centrically disposed filling aperture. The lid plate in the region of the drinking aperture may be provided with a drinking groove. The lid plate thus does not need to be configured so as to be completely planar. The lid plate may also be configured so as to be oblique in relation to the bearing face or to the upper side of the rolled lip rim of a cup.

The lid-plate element and the wall element are embodied so as to be separate, such that the lid is composed of at least two parts. The latter may then be adhesively bonded together and/or sealed together, for example. Preferably, the lid-plate element and/or the wall element are in each case configured so as to be from a sustainable raw material, for example from paper or paperboard. Preferably, this here involves a basic material which is structured or finished in such a manner that it does not soak through in typical applications. The lid plate and the wall element may have different wall thicknesses and/or be composed of different materials.

The lid may be embodied so as to be circular, for example. However, it may also be embodied so as to be angular, for example rectangular, wherein the corners are rounded even in the case of angular embodiments. This allows for adaptation to corresponding shaped cups.

The spacing is preferably between 5 mm and 20 mm. In this way, typical toppings of milk foam may preferably be received, without the overall dimensions of a cup having a lid placed thereon becoming too large.

According to one embodiment, the receptacle is configured as a corrugation in the wall element. This corresponds to a readily manufacturable embodiment. The wall element here in the region of the corrugation is preferably embodied having two layers. The corrugation may be reinforced in this way. For example, the wall element at a lower edge may be folded to this end.

According to one embodiment, the receptacle is configured by a bead in the lid-plate element, so as to be lateral to the lid plate. In this way the lid-plate element may assume the function of keeping the lid on a rolled lip rim, or spaced apart from the rolled lip rim, respectively. Preferably, a border having two layers, which is at least partially sealed to the wall element, is configured here between the bead and the lid plate. This border serves in particular for stabilization. Moreover, the lid-plate element may be fixedly connected to the wall element in this way.

According to one embodiment, the receptacle is configured by a number of indentations which are configured along the encircling wall and point inwards. In particular, this may mean that the receptacle does not bear on the rolled lip rim of a cup along the entire circumference, but only along a few portions. This allows for the creation of a special visual effect, for example, which is a result of the external surface which is obviously structured by means of the indentations.

According to one embodiment, the wall element is inwardly folded below the receptacle, so as to enable latching of the rolled lip rim of the beverage cup by way of a folded portion. This may secure the lid from being inadvertently removed. In order for the lid to be removed, the rolled lip rim initially has to be moved counter to a certain resistance caused by an undercut, wherein the undercut is formed by means of the folded portion. Configuring an undercut is possible without problems in the case of the lid according to the invention, on account of said lid being manufactured from paper or paper-like material. In the case of lids from plastics, which are manufactured by vacuum forming or injection moulding, this is not possible or only possible with great complexity. On account thereof, there are significant advantages which result from the lid according to the invention.

According to one embodiment, the lid-plate element laterally to the lid plate configures an encircling collar which is upwardly curved and is encompassed by a border of the wall element. This enables simple and reliable attachment of the lid-plate element to the wall element. To this end, the wall element may be folded on the border, in particular at an upper edge, such that a shorter and folded portion comes to lie inside. The collar of the lid-plate element is then received between this folded portion which lies inside and the remaining part of the wall element. Connecting the wall element to the lidplate element may be performed by adhesive bonding or sealing, for example.

According to one embodiment, the wall element and/or the lid-plate element at the upper end of the lid are outwardly rolled, while forming a rolled lip rim. In this way, the user of the lid, that is to say typically the consumer of a beverage which is contained in the cup which is closed by the lid, is offered a shape which is orally sensed and which is similar to the shape of a usual single-use beverage cup. The lid may then be provided with a hole, for example, through which the beverage is imbibed.

According to one embodiment, the encircling wall at least outside the receptacle assumes a constant angle in relation to the central axis.

According to one embodiment, the encircling wall in respective regions above and/or below the receptacle assumes a constant angle in relation to the central axis, and the encircling wall at an upper end region and/or at a lower end region is configured so as to be parallel with the central axis.

According to one embodiment, the encircling wall in a region above the receptacle is oriented so as to be parallel with the central axis.

According to one embodiment, the encircling wall in an upper end region widens towards the upper end.

Within the scope of the invention the aforementioned embodiments of the orientation of the encircling wall in relation to the central axis are at least partially also combinable. In this way, desirable visual appearances of a respective lid may be achieved.

According to one embodiment, the lid plate is obliquely placed in relation to the receptacle, and/or to the central axis. An oblique placement in relation to the receptacle here is in particular to be understood to be an oblique placement in relation to a plane in which the rolled lip rim of a cup extends when the lid is typically used as a top on the cup. It may be achieved in this way that a liquid, for example a beverage, which accumulates on the lid plate is routed in a defined manner to a specific position on the lid plate. This allows, for example, for liquid remaining on the lid plate to be returned back into the cup in a controlled manner via a hole in the lid plate. The liquid may also be collected in a defined manner. The consumer's head may also tip back to a lesser extent during drinking.

The invention furthermore relates to a cup assembly having a cup which has a rolled lip rim, and having a lid according to the invention, wherein a part of the receptacle of the lid, which sits on the rolled lip rim, has a width of at least half of the width of the rolled lip rim.

By means of the cup assembly according to the invention, the abovementioned advantages of a cup according to the invention may be achieved for a cup assembly. Hereby, reference may be made to all afore-described explanations and variants of the lid. Advantages explained in relation thereto correspondingly apply.

Advantageous mounting or an advantageous fit of the lid on the cup, respectively, is achieved by means of the described width of the receptacle of the lid or of the part sitting thereon, respectively. This has been demonstrated in practice.

The invention furthermore relates to a method for manufacturing a lid according to the invention, the method comprising the following steps:

providing a lid-plate element;

providing a wall element; and connecting the lid plate to the supporting element.

By means of the method according to the invention, a lid according to the invention may be advantageously manufactured. In doing so, reference may be made to all afore-described variants and embodiments of the lid. Advantages explained in relation thereto correspondingly apply.

BRIEF DESCRIPTION OF THE DRAWINGS

The invention will be described hereunder by means of a plurality of exemplary embodiments illustrated in the figures. In principle, the respective features of the individual exemplary embodiments may be mutually combined as desired. In the drawings.

Figure 1A:
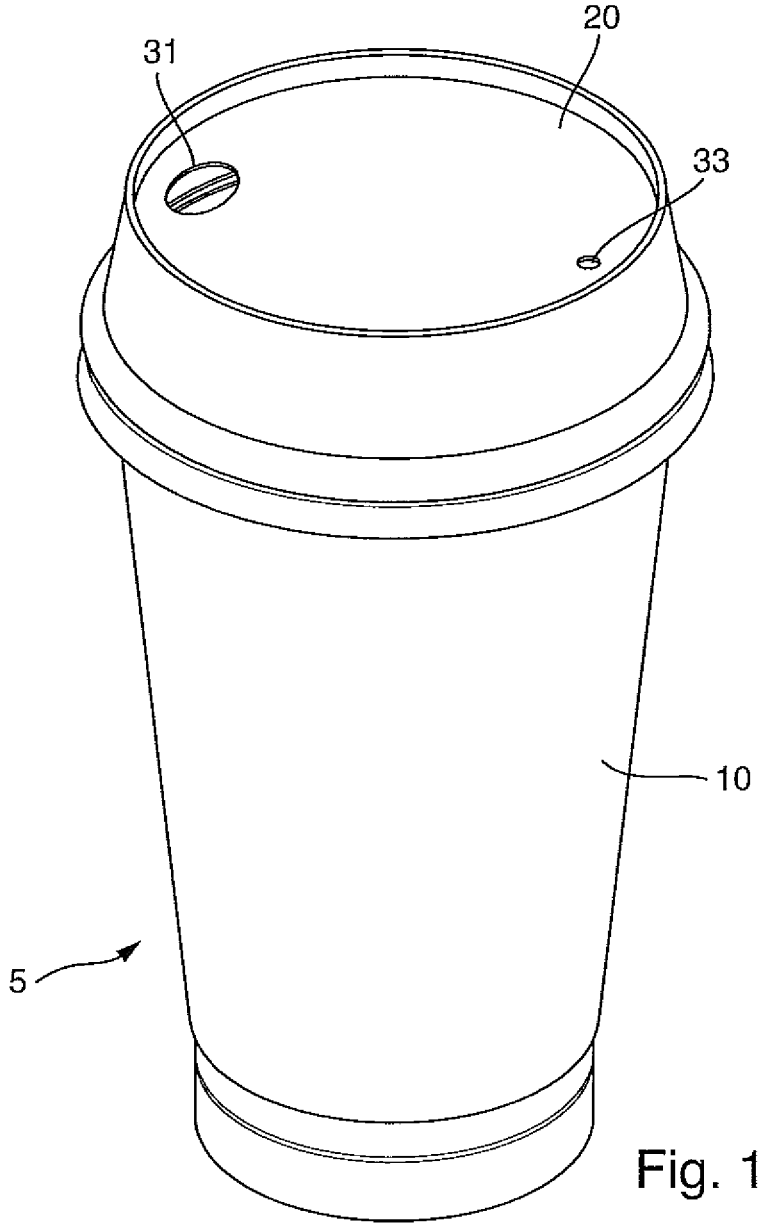
FIGS. 1*a* to 1*d* show a cup assembly having a lid according to a first exemplary embodiment.
Figure 1B:
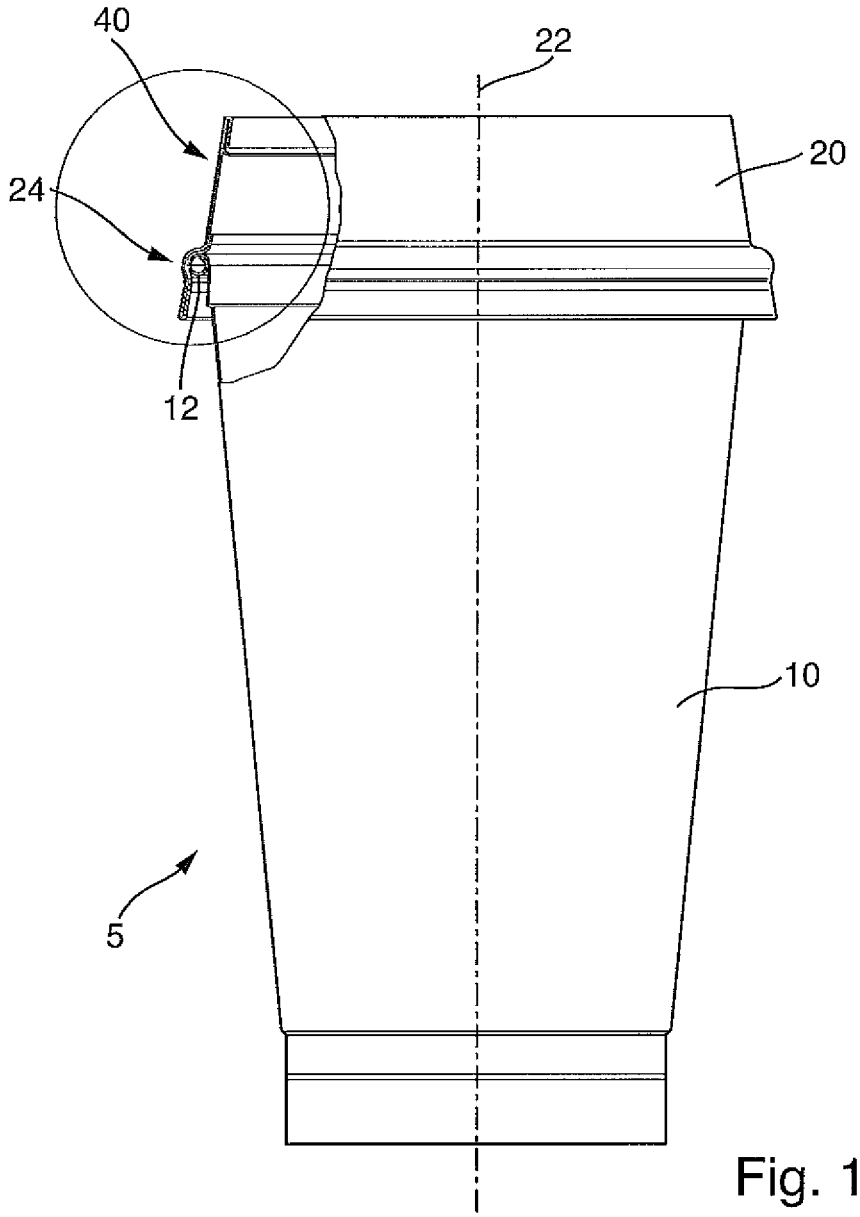
Figure 1C:
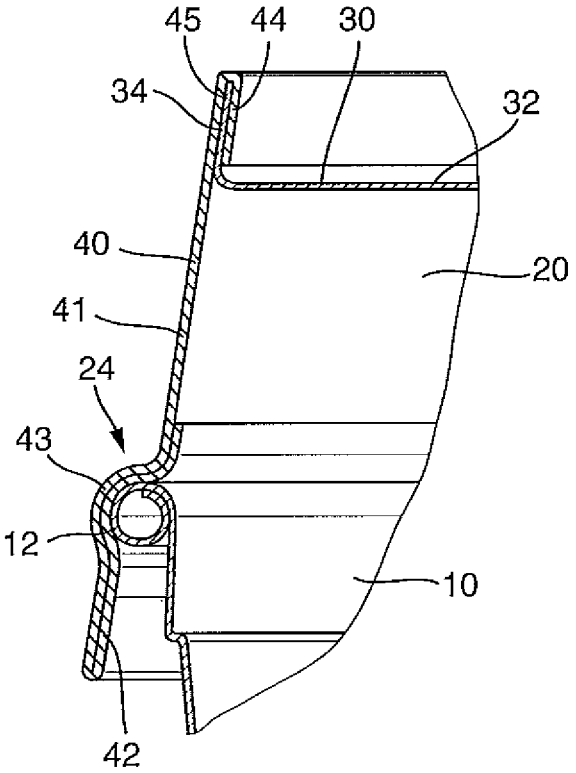

In the figures which are referred to using the letter "a", in each case one cup assembly 5 having in each case one cup 10 and one lid 20 according to the respective exemplary embodiment is illustrated in a perspective view.

In the figures which are referred to using the letter "b", the respective cup assembly 5 is illustrated in a sectional view, a respective central axis 22 being additionally included in the drawing. The central axis 22 is in each case a central axis for both the lid 20 as well as the cup 10. Furthermore, in the figures which are in each case referred to using the letter "b", in each case one detail which in the figure which is in each case referred to using the letter "c" is illustrated in more detail is included in the drawing. This only does not apply to the sixth exemplary embodiment.

In the figures which are in each case referred to using the letter "d", in each case one first lid 20 and one second lid 20*a* which are stacked on top of one another are shown. Again, the sixth exemplary embodiment is an exception to this rule, such an illustration being shown in FIG. 6*c*. Here, the central axis 22 is again respectively included in the drawing.

DETAILED DESCRIPTION

There now first follows a description of features which are present in all exemplary embodiments. The respective particular features of the exemplary embodiments will then be separately discussed.

The cup assemblies 5 according to the invention have in each case one cup 10 which on its upper periphery has an encircling rolled lip rim 12. The rolled lip rim 12 is configured in that a sleeve of the cup 10 is outwardly rolled. For the consumer enjoying a beverage which is contained in the cup 10 without the lid 20, this results in a pleasant sensation when drinking.

The respective lid 20 is attached onto the cup 10. The lid 20 has in each case one receptacle 24 which is configured so as to bear on the rolled lip rim 12 of the cup 10. This serves to provide stable retention of the lid 20 on the cup 10. The lid 20 is provided with a first large hole 31 through which the beverage may be imbibed or through which a drinking straw may be inserted. A further small hole 33 in the lid 20 serves for ventilation and, if and when required, for returning liquid from the lid 20 into the cup 10.

The respective lid 20 has in each case one wall element 40. This forms an encircling wall 41, that is to say an outer sleeve of the lid 20, which is rotationally symmetrical.

The lid 20 furthermore has in each case one lid-plate element 30 which is connected to the wall element 40 by way of adhesive bonding. The lid-plate element 30 forms a lid plate 32 which in particular is planar. The term "planar" is to be understood in particular to mean that the lid plate 32, when observed in the usual manner, appears to be smooth. This does not exclude the possibility that said lid plate 32 may be inclined in relation to the central axis 22. A hole 31 for imbibing is configured in the respective lid-plate element 30.

In the case of the first exemplary embodiment, which is illustrated in FIGS. 1*a* to 1*d*, the receptacle 24 has been implemented by a corrugation 43 which is configured in the wall 41. As is shown, said corrugation 43 is outwardly curved and thus enables the rolled lip rim 12 of the cup 10 to be received. On account of the embodiment shown, in which the wall 41 below the rolled lip rim 12 is again slightly inclined in an inward manner, a certain latching effect of the rolled lip rim 12 is also achieved. This avoids the lid 20 being inadvertently removed from the cup 10.

Outside the corrugation 43, an angle of the side wall in relation to the central axis 22 is constant. This applies to portions of the wall 41 which are above as well as below the corrugation 43.

At the lower end thereof, the wall element 40 is folded, such that a folded portion 42 of the wall element 40 lying on the inside is present, which extends somewhat beyond the corrugation 43. The wall element 40 is thus configured in two layers, in particular in the region of the corrugation 43. This enhances the stability of the wall element 40 in the region of the corrugation 43.

At the upper end thereof, the wall element 40 is likewise folded inwards such that a further folded portion 44 lying on the inside is configured. The lid-plate element 30 at the outer end thereof simultaneously forms a collar 34 which points upwards. The collar 34 is received in the folded wall element 40 in such a manner that said collar 44 is contacted on the inside by the further folded portion 44 of the wall element 40. Such a design of the wall element 40 is also referred to as the border 45.

An angle of the encircling wall 41 in relation to the central axis 22 in the lid 20 according to the first exemplary embodiment is constant outside the corrugation 43.

Figure 1D:
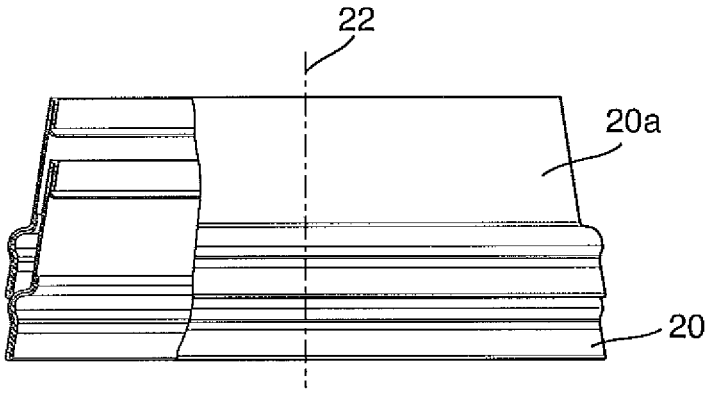
Figure 2A:
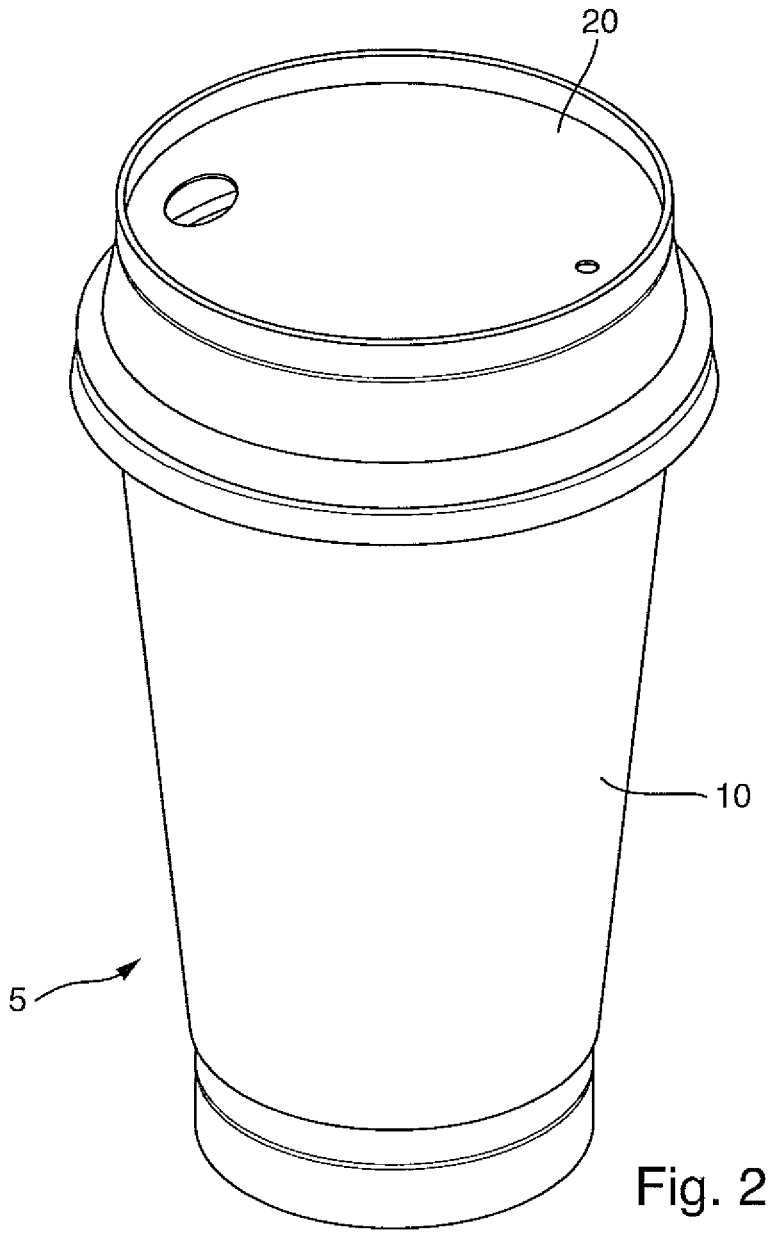
FIGS. 2*a* to 2*d* show a cup assembly having a lid according to a second exemplary embodiment.
Figure 2B:
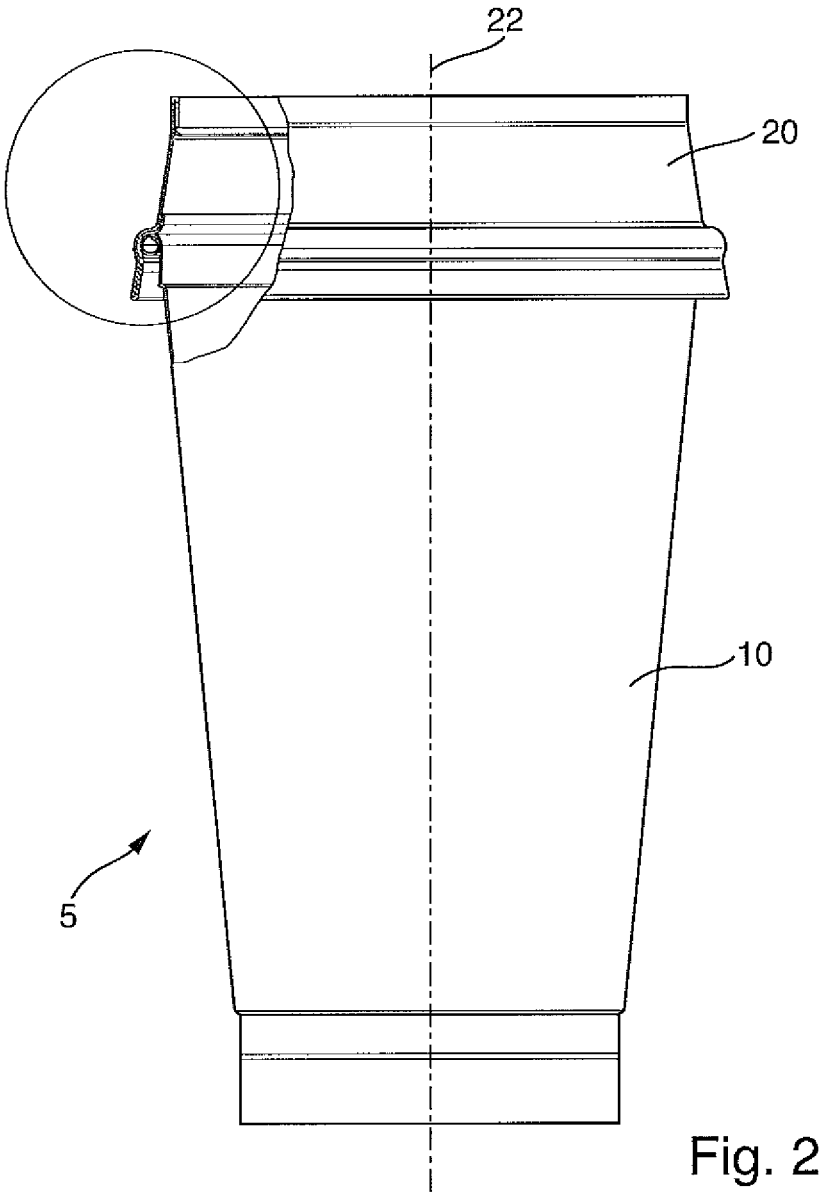
Figure 2C:
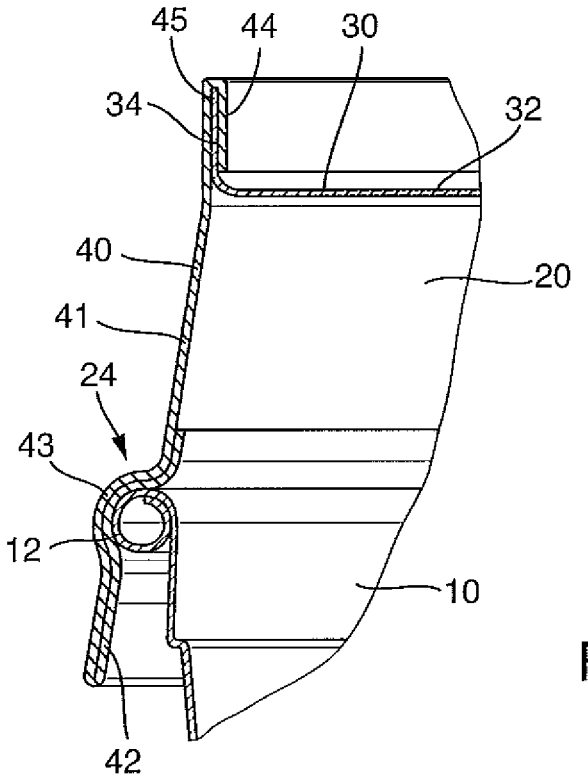
Figure 2D:
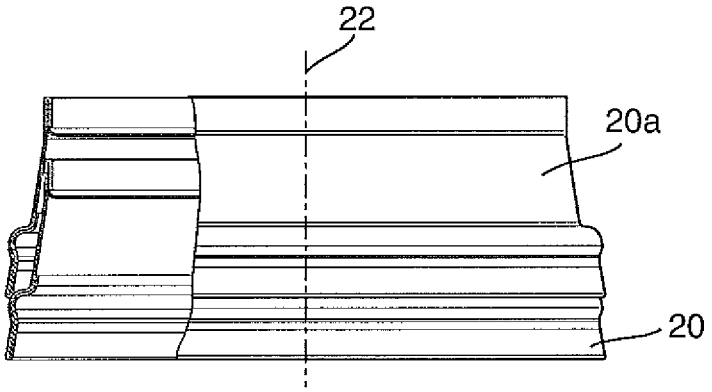
Figure 3A:
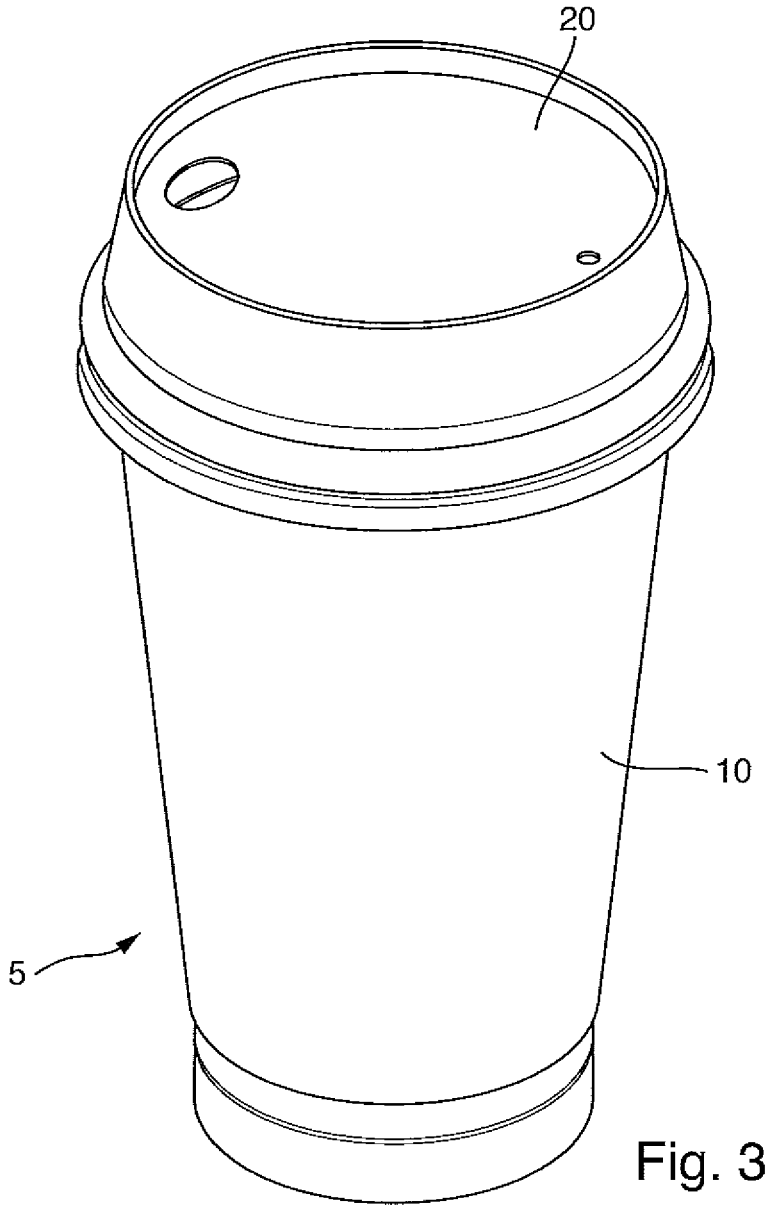
FIGS. 3*a* to 3*d* show a cup assembly having a lid according to a third exemplary embodiment.
Figure 3B:
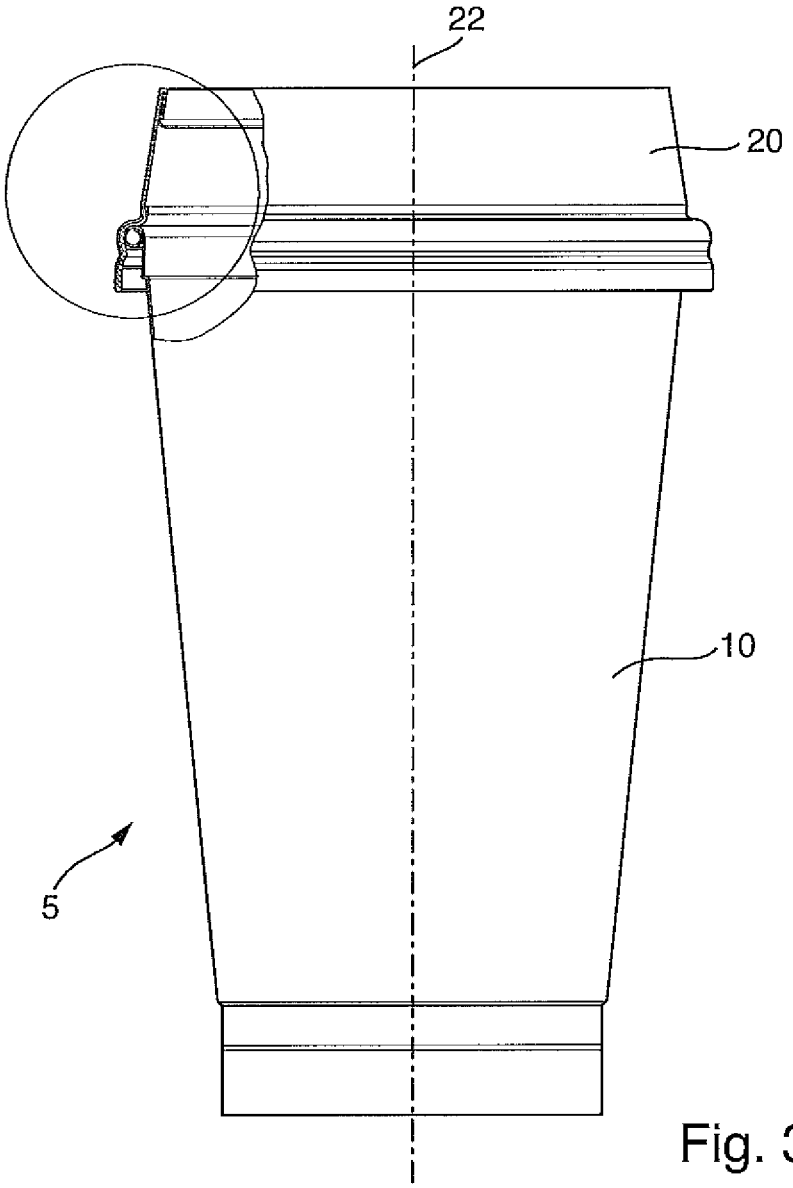
Figure 3C:
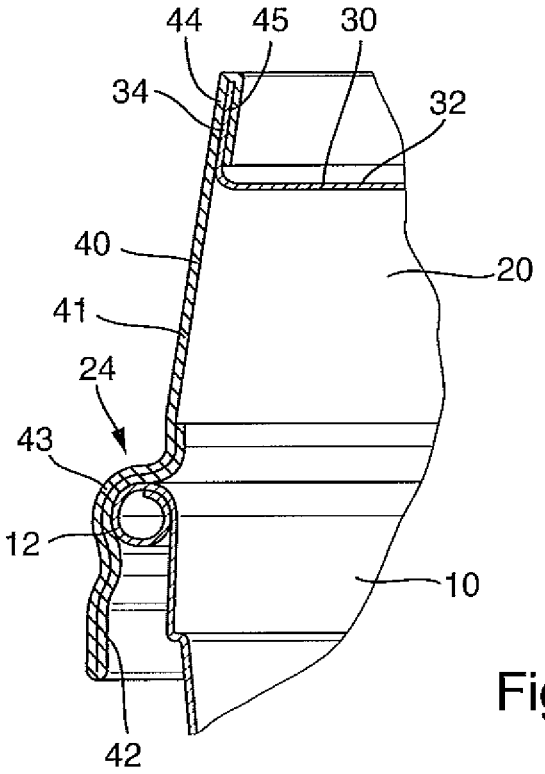
Figure 3D:
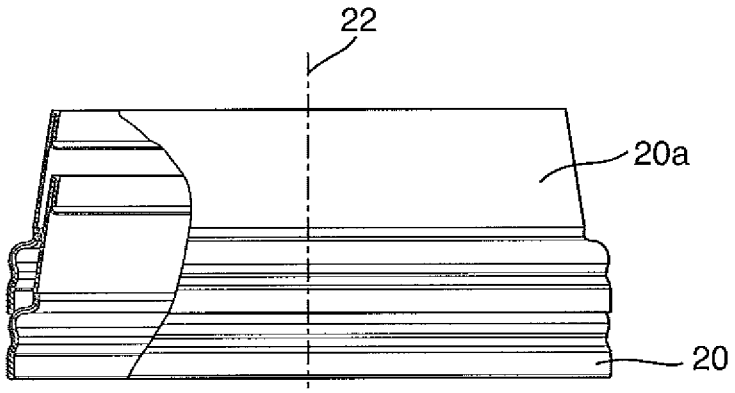
Figure 4A:
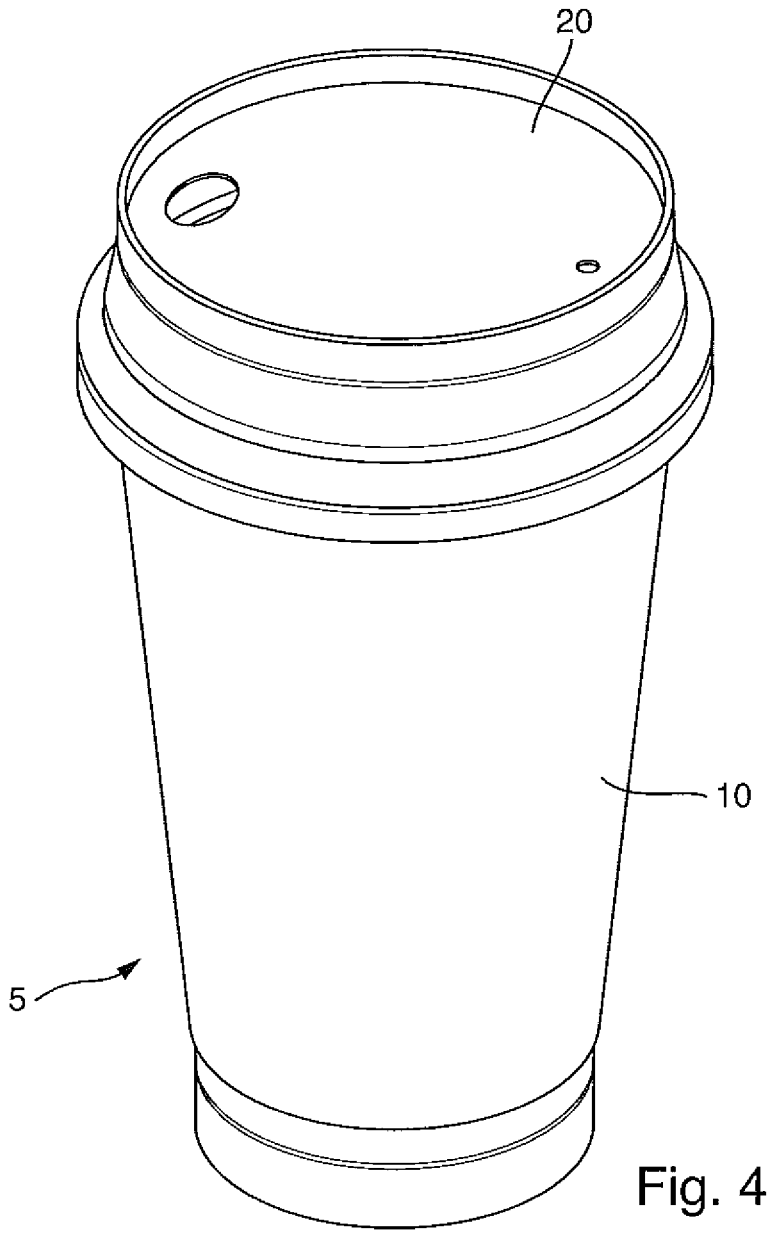
FIGS. 4*a* to 4*d* show a cup assembly having a lid according to a fourth exemplary embodiment.
Figure 4B:
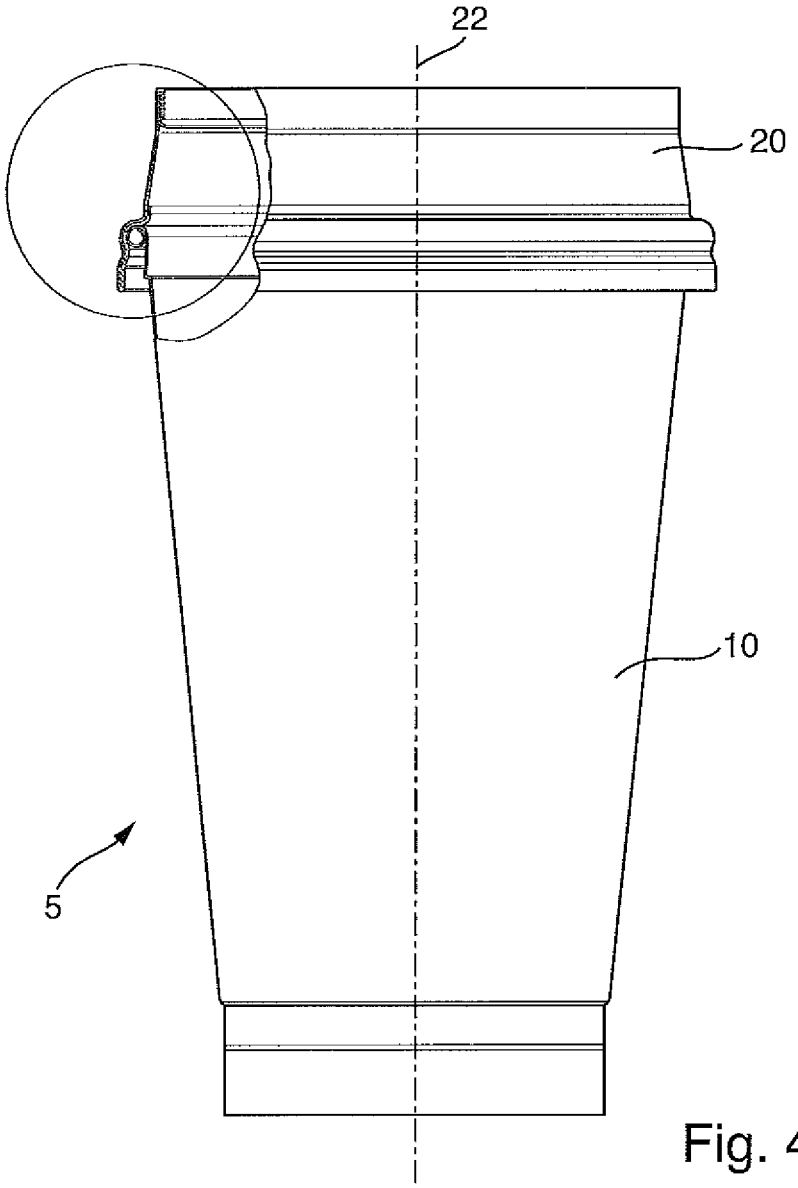
Figure 4C:
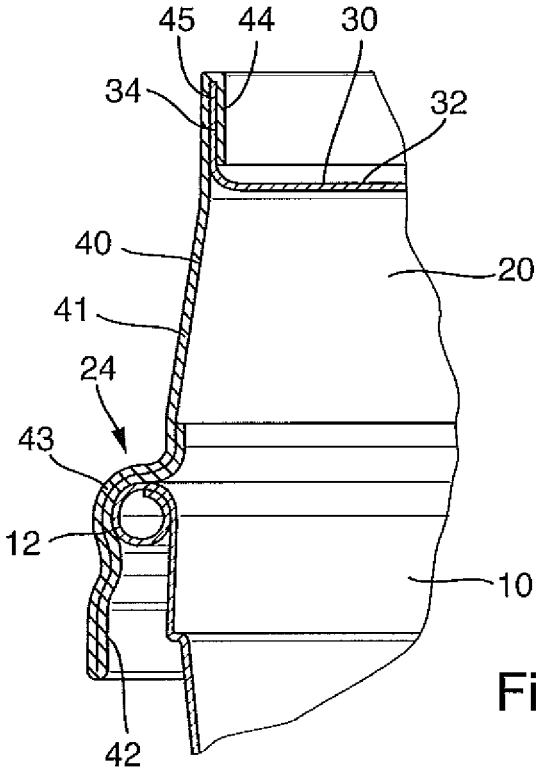
Figure 4D:
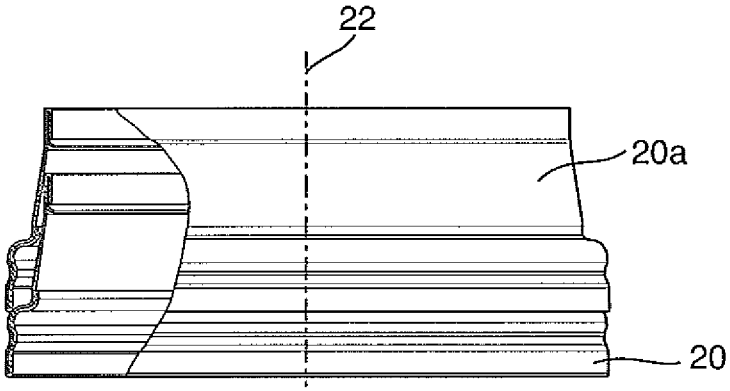

Two stacked lids 20, 20*a* are illustrated in FIG. 1*d*. The lower periphery of the upper lid 20*a* bears on the corrugation 43 of the lower lid 20.

The lid 20 according to the second exemplary embodiment, which is illustrated in FIGS. 2*a* to 2*d*, differs from the lid 20 according to the first exemplary embodiment only in that the angle of the encircling wall 41 deviates in the region of the border 45. Specifically, the encircling wall 41 in the region of the border 45 is configured so as to be parallel with the central axis 22.

The lid 20 according to the third exemplary embodiment, which is illustrated in FIGS. 3*a* to 3*d*, differs from the lid 20 according to the first exemplary embodiment in that the wall element 41 in a lower end region deviates from the angle otherwise present and is configured so as to be parallel with the central axis 22. This likewise applies to the lower portion 42. Furthermore, the corrugation 43 is more prominent than in the lid 20 according to the first exemplary embodiment.

The lid 20 according to the fourth exemplary embodiment, which is illustrated in FIGS. 4*a* to 4*d*, differs from the lid 20 according to the third exemplary embodiment in that the angle of the encircling wall 41 in relation to the central axis 22 deviates from the angle lying directly therebelow also in the region of the border 45. The wall element 40 in the region of the border 45 is configured so as to be parallel with the central axis 22, as is also the case in the second exemplary embodiment.

The lid 20 according to the fifth exemplary embodiment, which is illustrated in FIGS. 5*a* to 5*d*, differs from the lid 20 according to the second exemplary embodiment in that the lid plate 32 is placed so as to be oblique in relation to the central axis 22. This makes it possible to ensure that liquid on the lid plate 32 is exposed to a slope and thus accumulates at a defined position. In this way, the liquid may be more easily removed, for example wiped, from the lid plate 32. This here typically is liquid which makes its way onto the lid plate 32 and remains thereon when, for example, the cup 10 having the lid 20 is tilted forward for imbibing and tilted back thereafter.

Figure 5A:
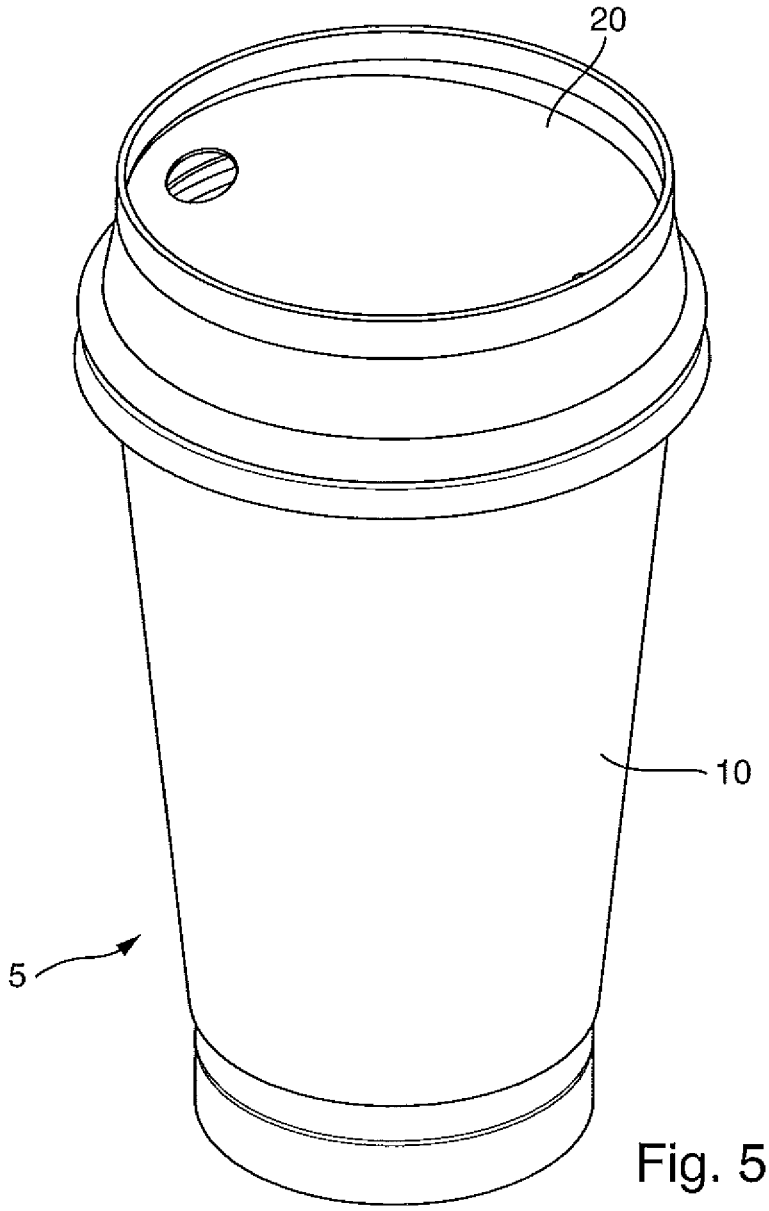
FIGS. 5*a* to 5*d* show a cup assembly having a lid according to a fifth exemplary embodiment.
Figure 5B:
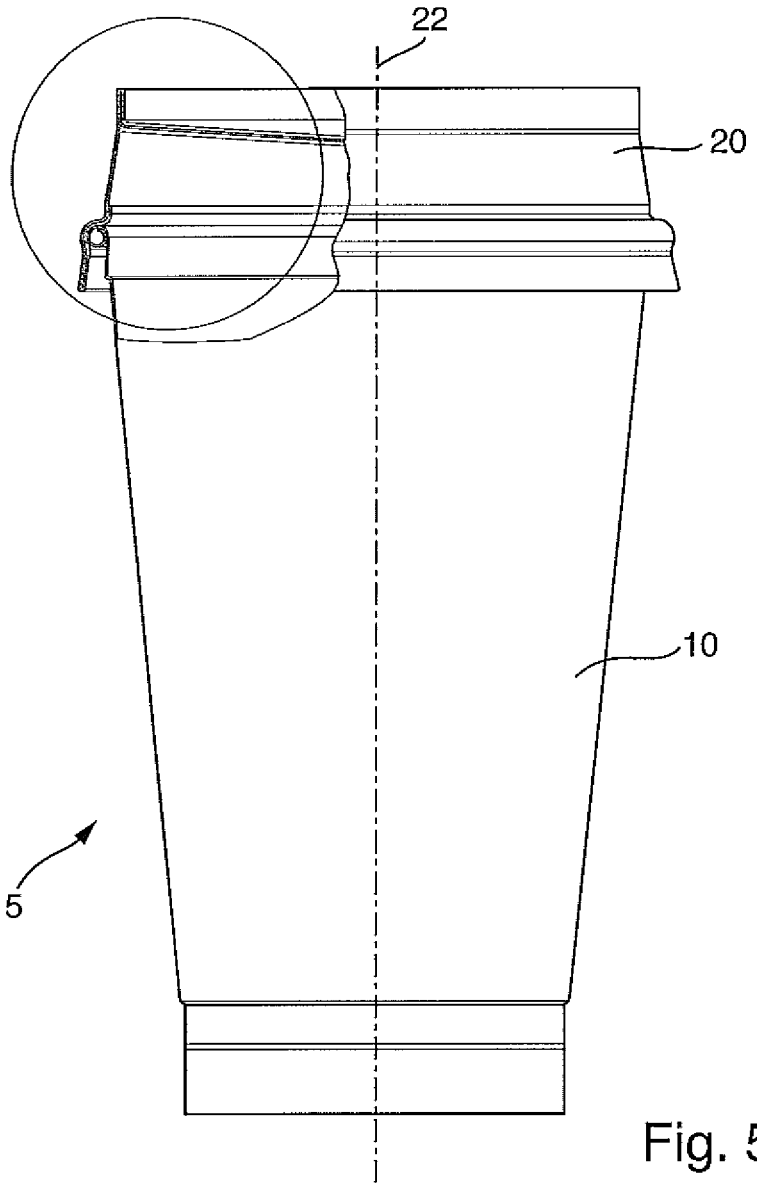
Figure 5C:
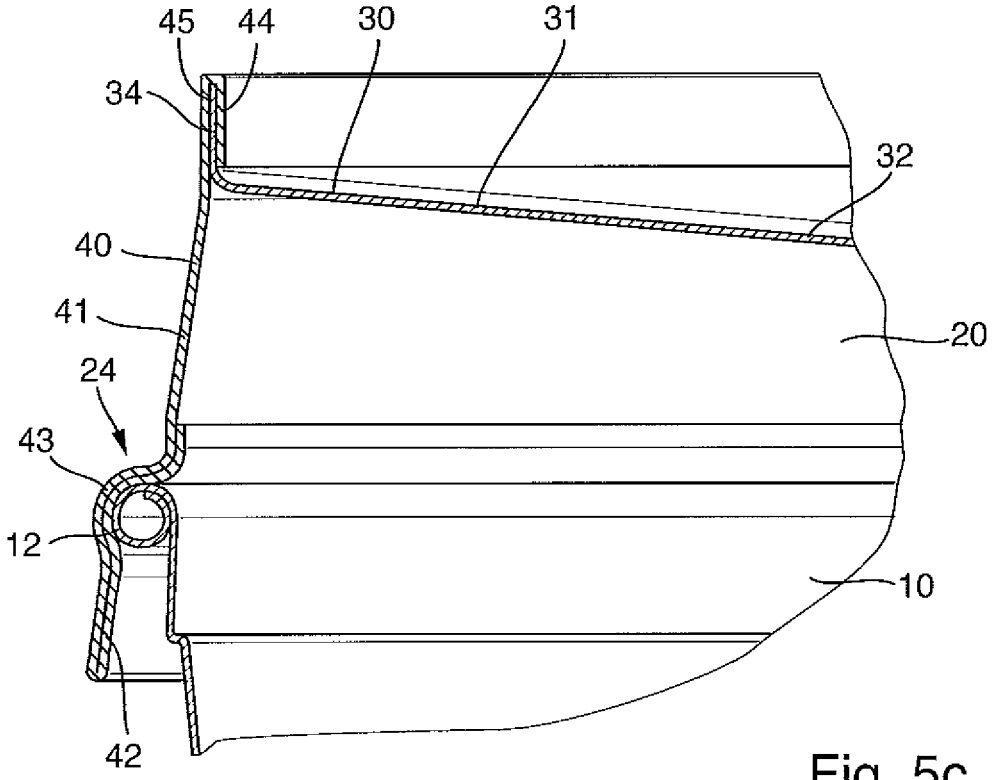
Figure 5D:
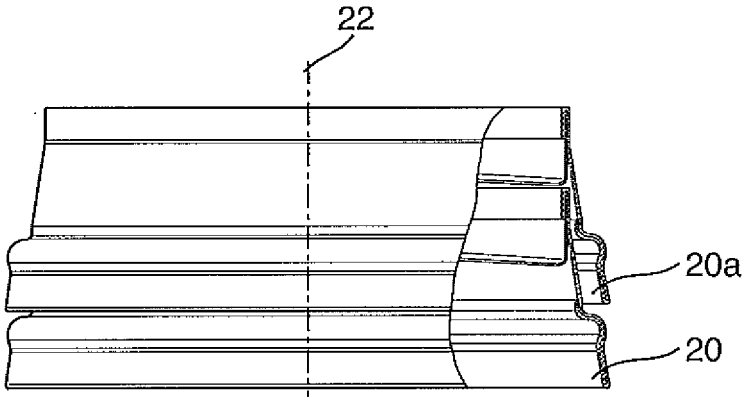

FIG. 5*d* shows two stacked lids 20, 20*a*. The lid plate 32 of the upper lid 20*a*, by way of its lowest point, bears on the upper edge of the border 45 of the lower lid 20.

Figure 6A:
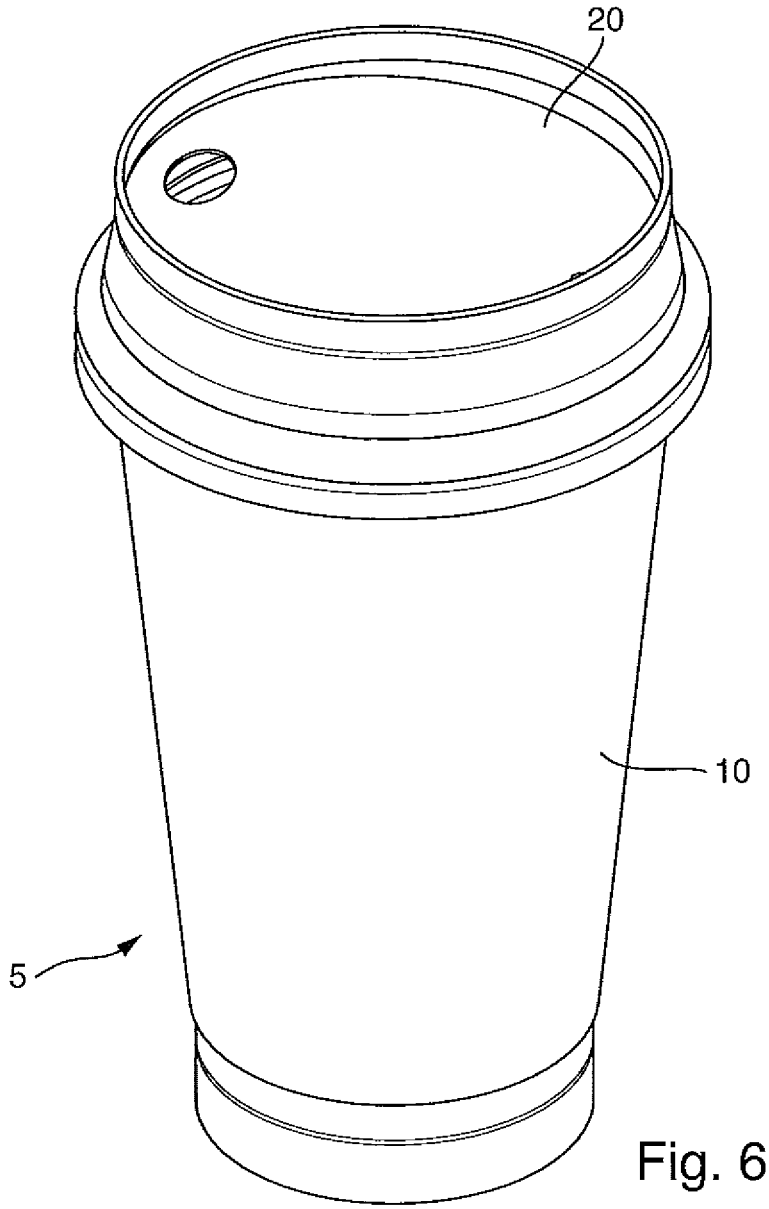
FIGS. 6*a* to 6*c* show a cup assembly having a lid according to a sixth exemplary embodiment.
Figure 6B:
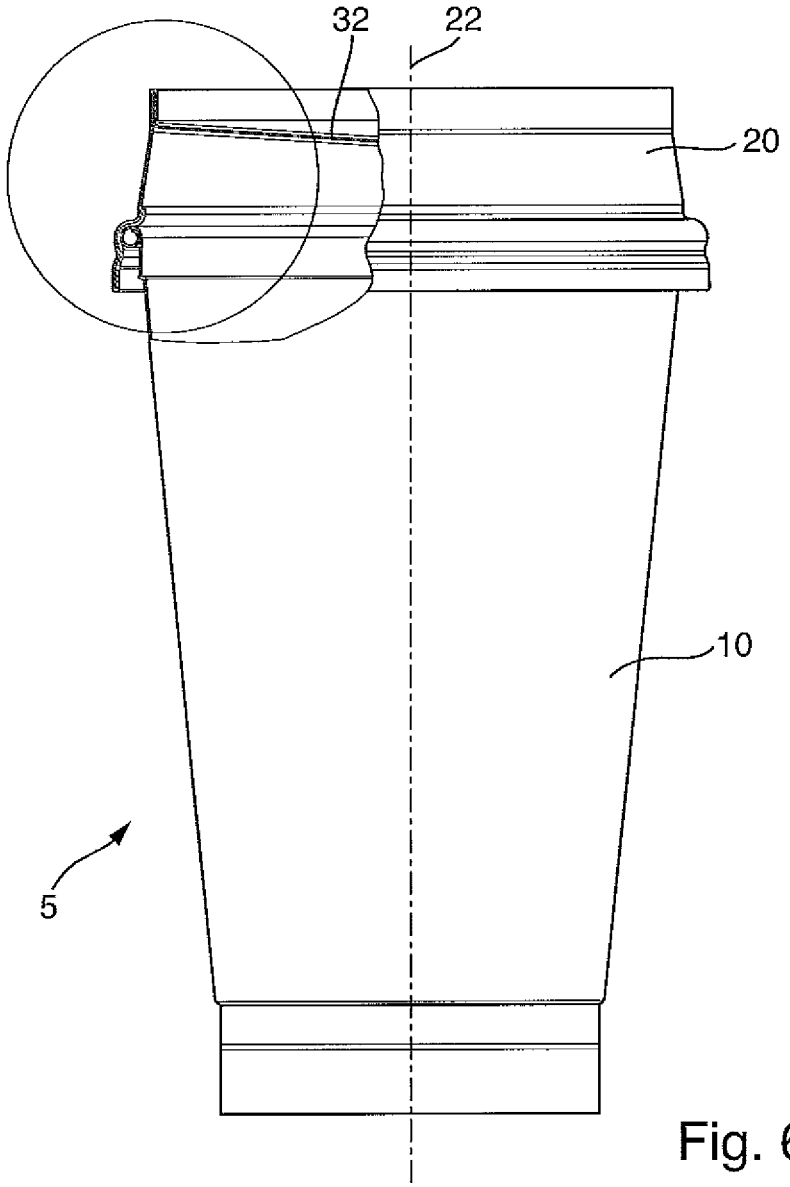
Figure 6C:
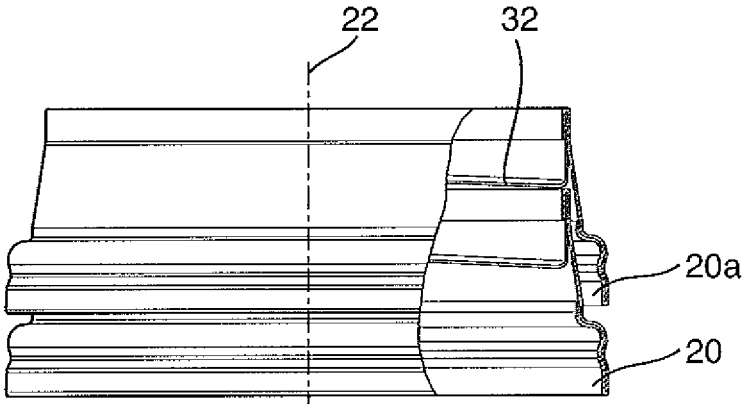

The lid 20 according to the sixth exemplary embodiment, which is illustrated in FIGS. 6*a* to 6*c*, differs from the lid 20 according to the fourth exemplary embodiment in that the lid plate 32 is placed so as to be oblique in relation to the central axis 22. In this way, the same advantages are achieved as have been described with reference to the fifth exemplary embodiment. The lower periphery of the lid 20 is designed as in the case of the third exemplary embodiment of FIGS. 3*a* to 3*d*.

In the lid 20 according to the seventh exemplary embodiment, which is illustrated in FIGS. 7*a* to 7*d*, the receptacle 24 is configured differently from those in the first to the sixth exemplary embodiments. The lid-plate element 30 is bent downwards, so as to configure a bead 36 which bears on the rolled lip rim 12 of the lid 10. The bead 36 here is shaped by way of suitable bending of the lid-plate element 30. The lid-plate element 30, above the bead 36, configures a region 38 having two layers, which is adhesively bonded to the wall element 40. This leads to particularly high stability in this region 38.

In order to enable latching of the rolled lip rim 12, a comparatively small corrugation 47, which partially encompasses the rolled lip rim 12 of the cup 10 from below, is configured in the wall element 40, below the rolled lip rim 12.

Figure 7A:
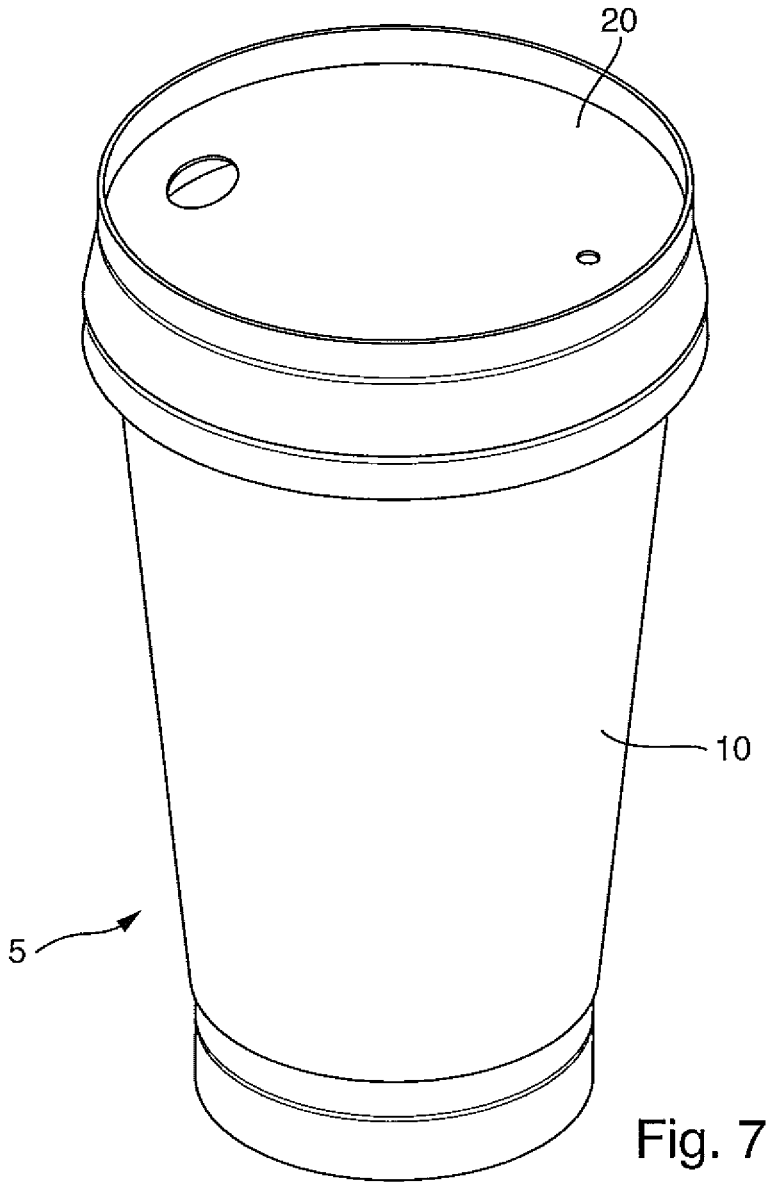
FIGS. 7*a* to 7*d* show a cup assembly having a lid according to a seventh exemplary embodiment.
Figure 7B:
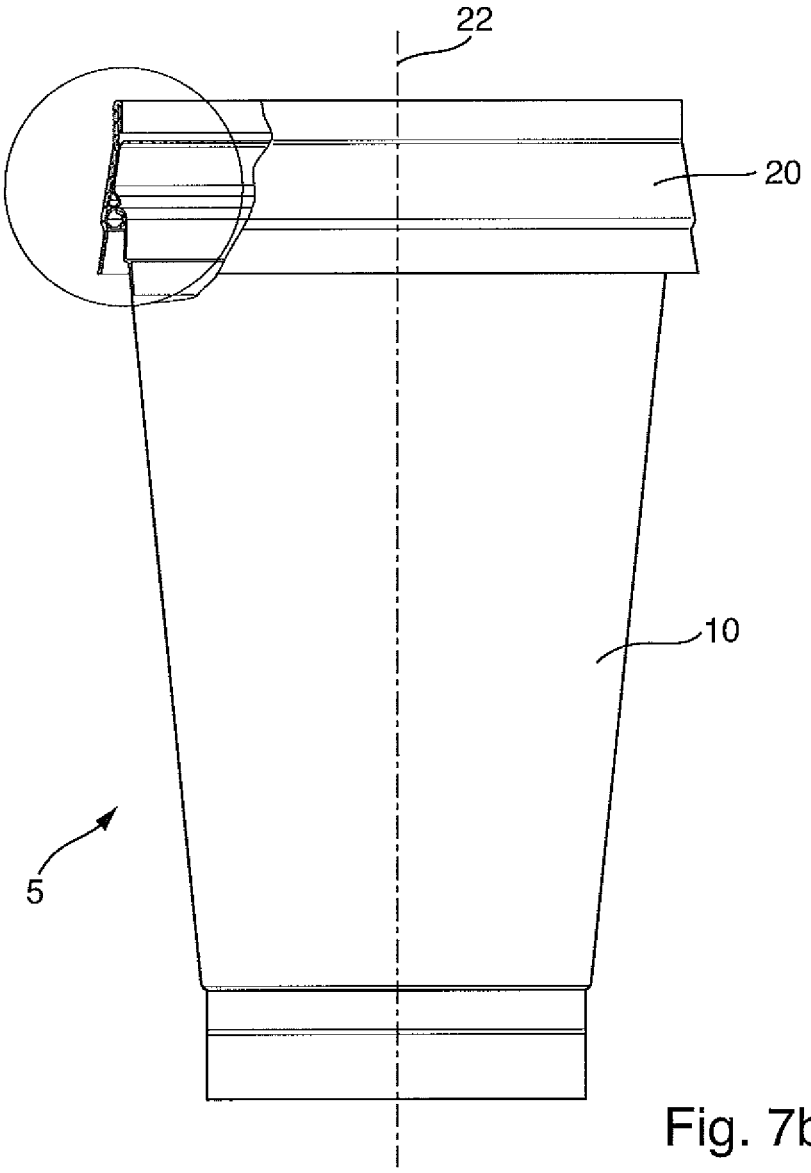
Figure 7C:
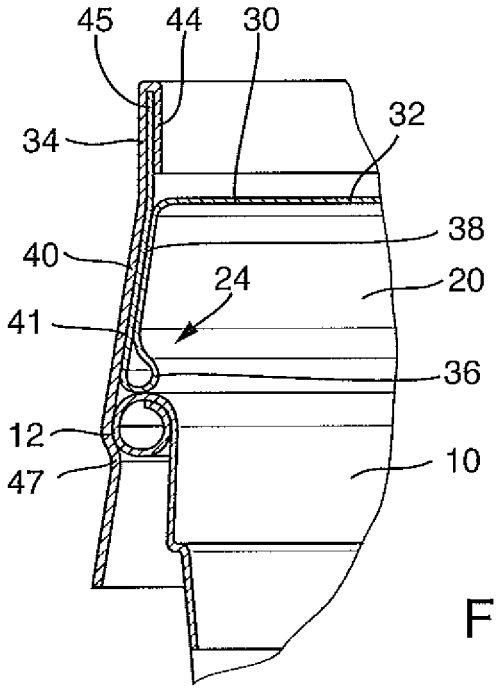
Figure 7D:
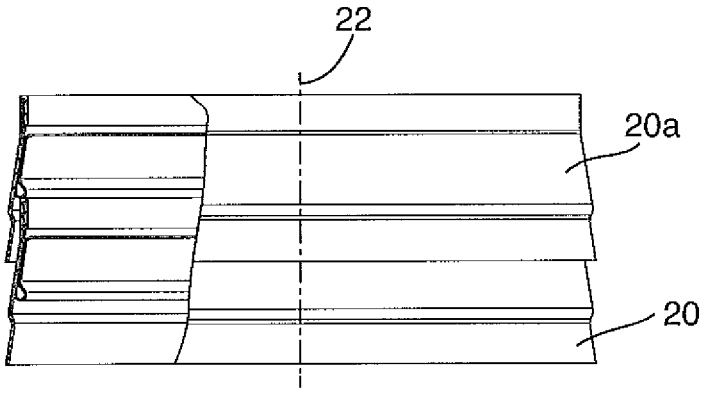
Figure 8A:
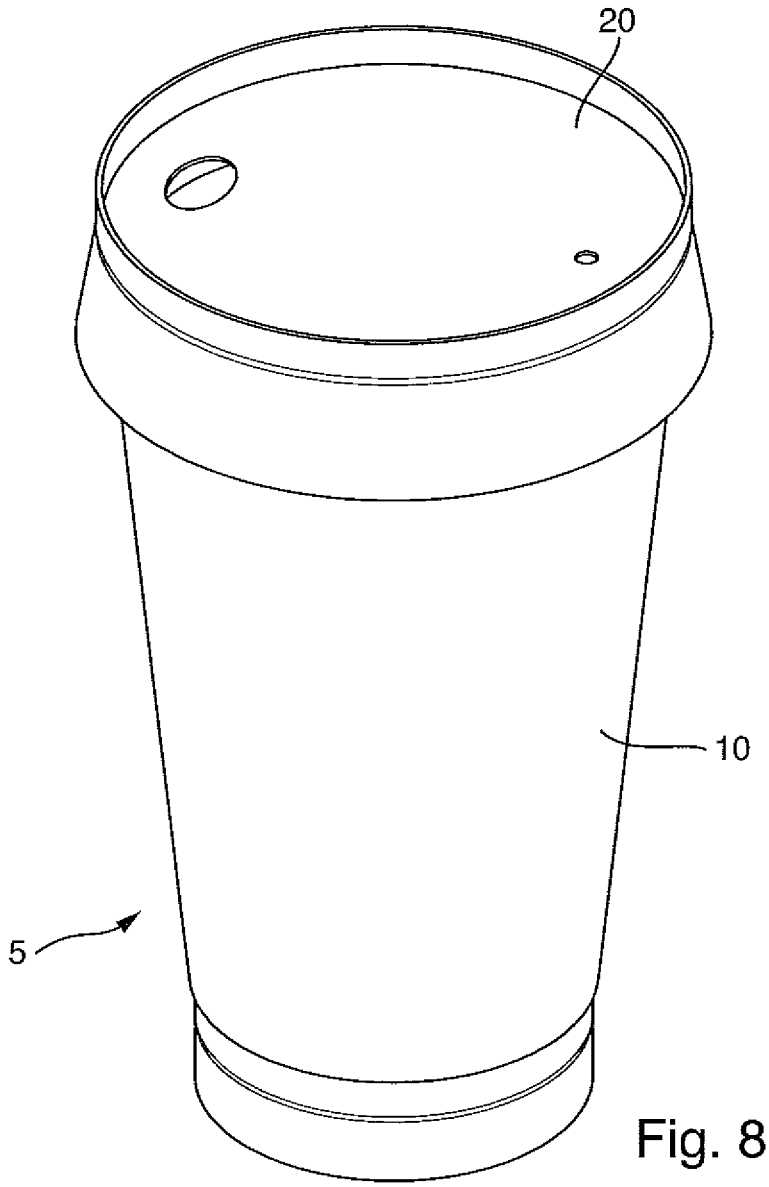
FIGS. 8*a* to 8*d* show a cup assembly having a lid according to an eighth exemplary embodiment.
Figure 8B:
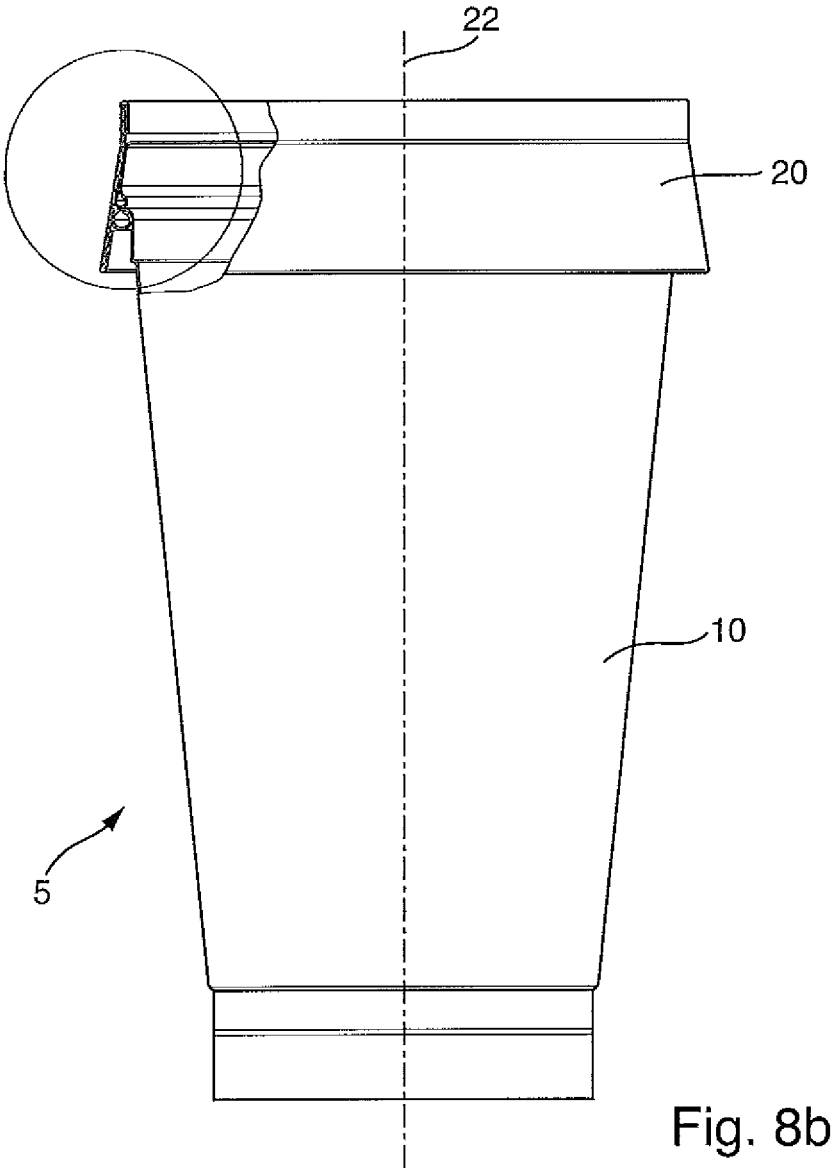
Figure 8C:
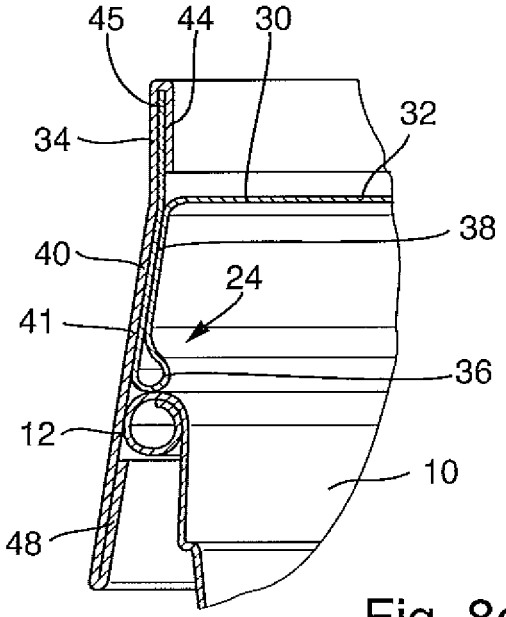
Figure 8D:
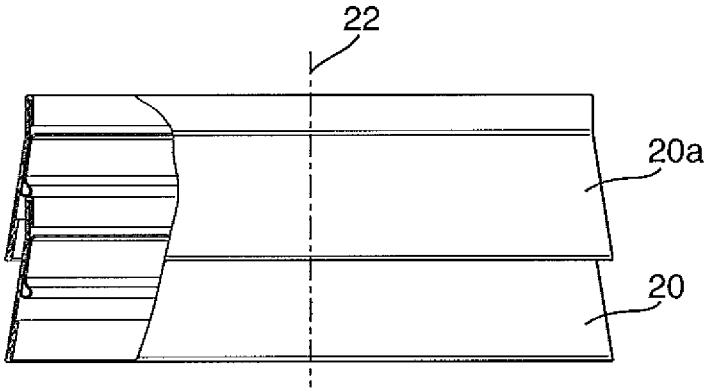

FIG. 7*d* shows two stacked lids 20, 20*a*. The bead 36 of the upper lid 20*a* bears on the upper periphery of the border 45 of the lower lid 20.

The lid 20 according to the eighth exemplary embodiment, which is illustrated in FIGS. 8*a* to 8*d*, differs from the lid 20 according to the seventh exemplary embodiment in that the lower latching feature is not configured by a small corrugation 47 but by a portion 48 of the wall element 40, which is folded by 180°. This also enables defined latching of the rolled lip rim 12, since the folded portion 48 terminates below the rolled lip rim 12. Inadvertent removal of the lid 20 from the cup 10 is thus avoided.

In the lid 20 according to the ninth exemplary embodiment, which is illustrated in FIGS. 9*a* to 9*d*, the receptacle 24 is again configured in a different manner. The receptacle 24 here is embodied by means of a number of inwardly pointing indentations 46 which are configured along the encircling wall 41. Said indentations 46 are in each case embodied such that at the bottom thereof they offer a bearing face for the rolled lip rim 12 of the cup 10. The indentations 46 may also be referred to as cams, for example.

A portion 48 of the wall element 40, which is inwardly folded by 180° and which enables latching of the rolled lip rim 12 of the cup 10 from below, is again located below the rolled lip rim 12. Above the lid plate 32, the wall element 40 furthermore widens towards the outside, such that said wall element 40 below the rolled lip rim 12 has the shape of a truncated cone.

Figure 9A:
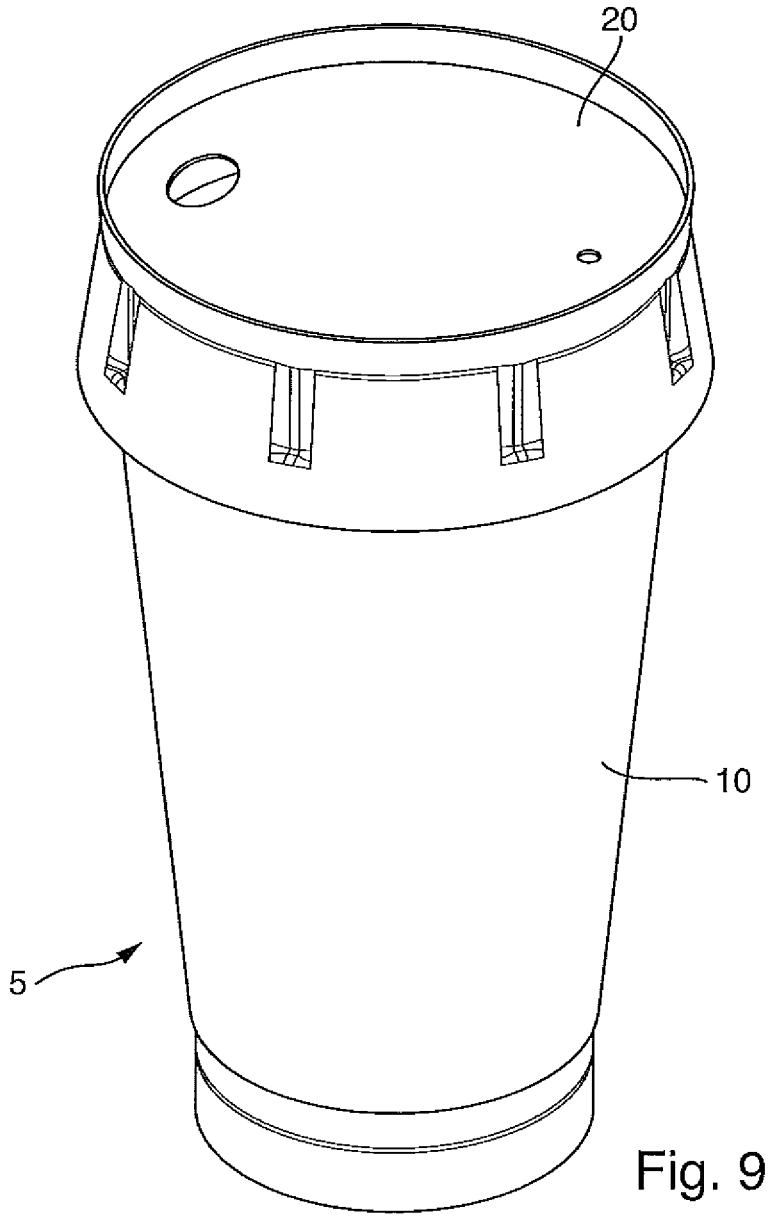
FIGS. 9*a* to 9*d* show a cup assembly having a lid according to a ninth exemplary embodiment.
Figure 9B:
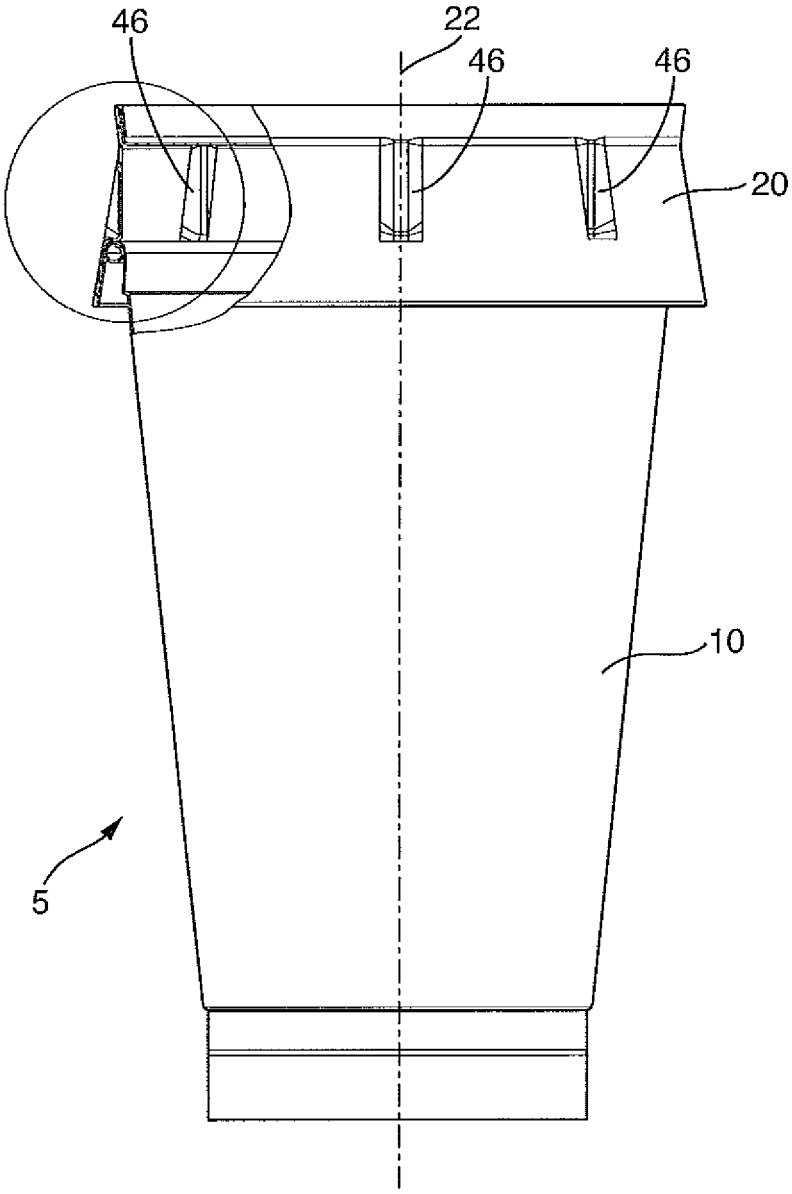
Figure 9C:
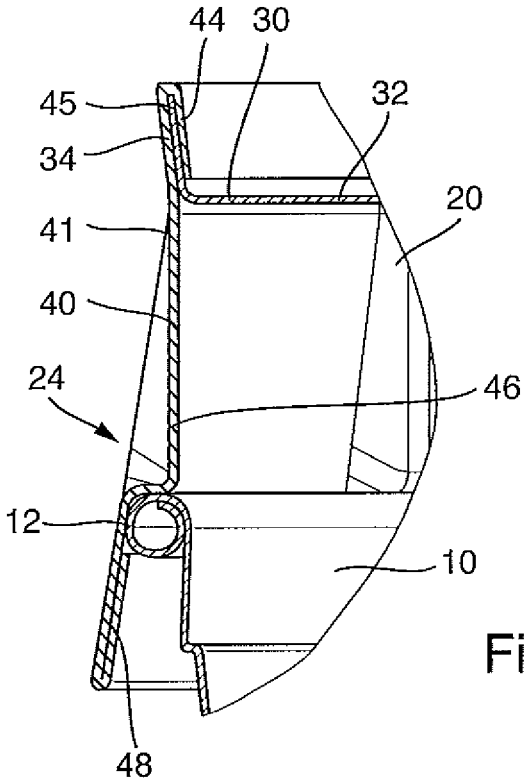
Figure 9D:
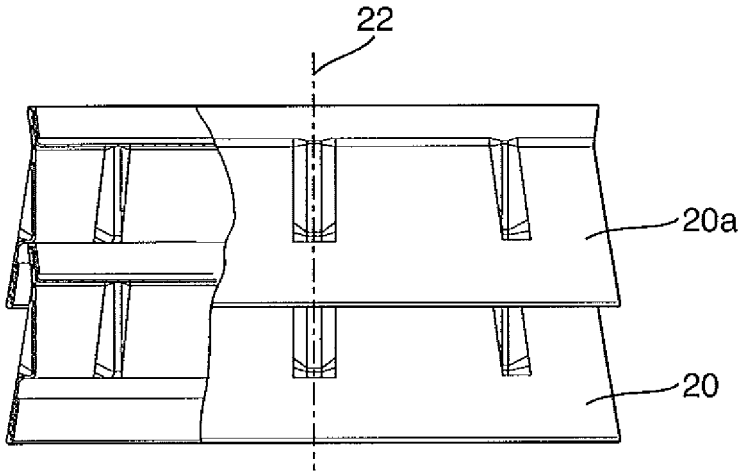

FIG. 9*d* shows two stacked lids 20, 20*a*. The upper lid 20*a*, by way of the bearing faces of the indentations 46, bears on the upper periphery of the border 45 of the lower lid 20.

In the lid 20 according to the tenth exemplary embodiment, which is illustrated in FIGS. 10*a* to 10*d*, the receptacle 24 is again configured by an encircling corrugation which, however, is configured so as to be shallower as compared to the corrugations 43 of the first to sixth exemplary embodiments. Below the rolled lip rim 12, said rolled lip rim 12 is again latched by way of a folded portion 48 of the wall element 40.

In contrast to the previous exemplary embodiments, the lid-plate element 30 is not retained in a border 45 of the wall element 40 but on its periphery is rolled up towards the outside and thus forms a further rolled lip rim 50. The lid-plate element 30 is fastened to the wall element 40 at an upper portion of the wall element 40 where the wall element 40 and the lid-plate element 30 run parallel with one another. The further rolled lip rim 50 which is configured on the outside offers the consumer a sensation which is very similar to the sensation in the case where the consumer consumes the beverage which is contained in the cup 10 without the lid 20. In that case, the rolled lip rim 12 of the lid 10 would be immediately next to the consumer's mouth. The further rolled lip rim 50 of the lid 20 imitates that sensation.

Figure 10A:
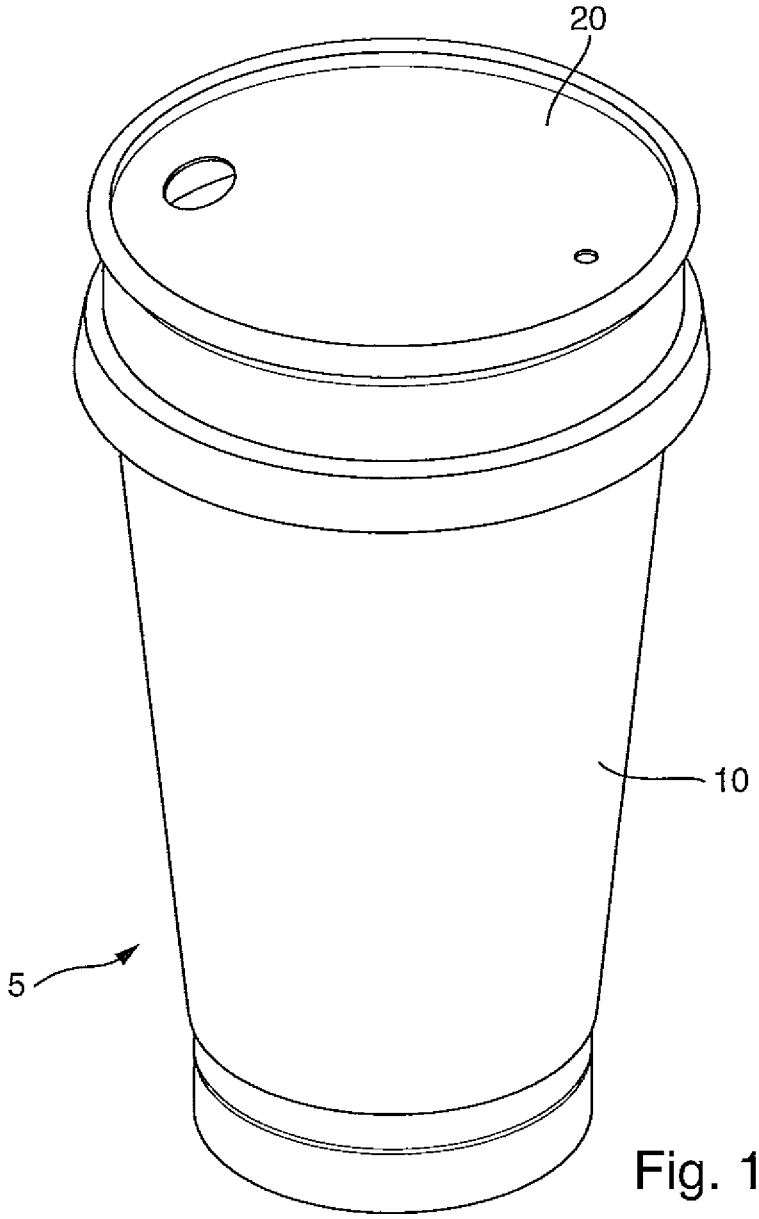
FIGS. 10*a* to 10*d* show a cup assembly having a lid according to a tenth exemplary embodiment.
Figure 10B:
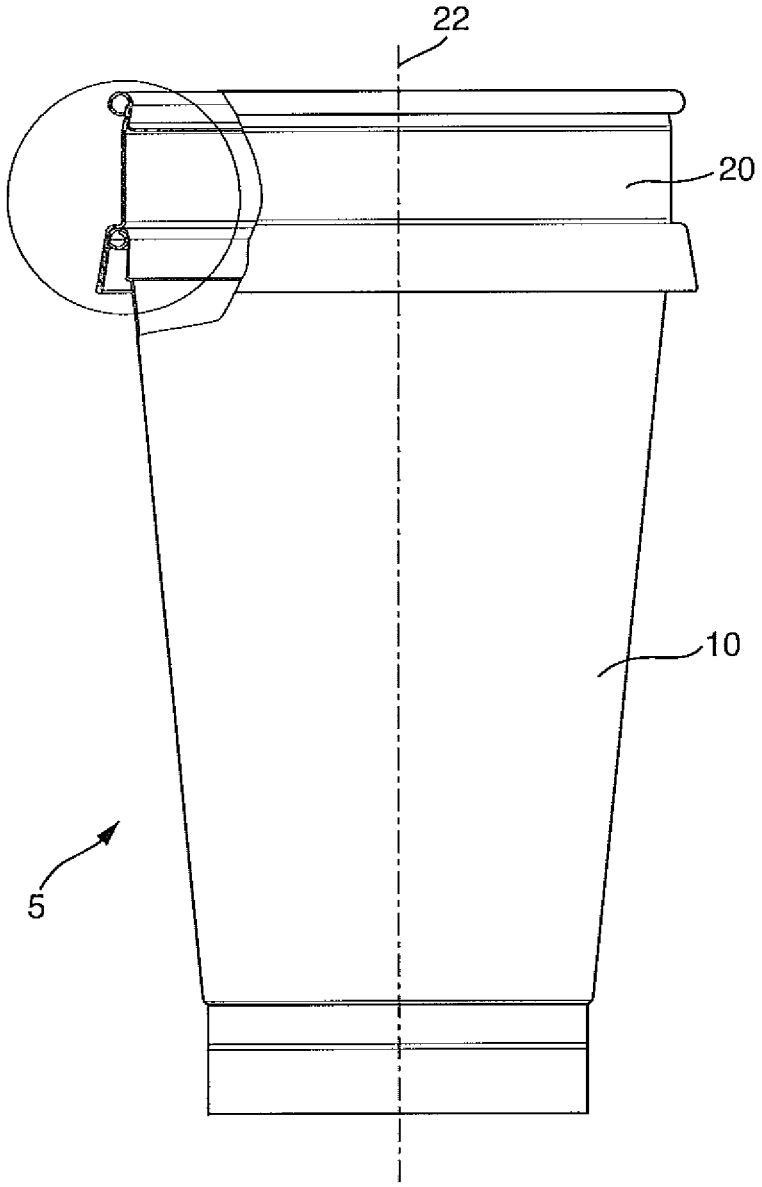
Figure 10C:
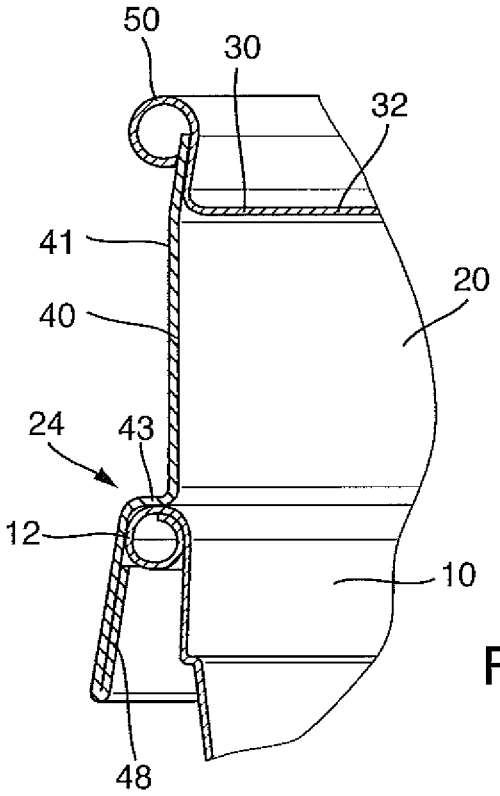
Figure 10D:
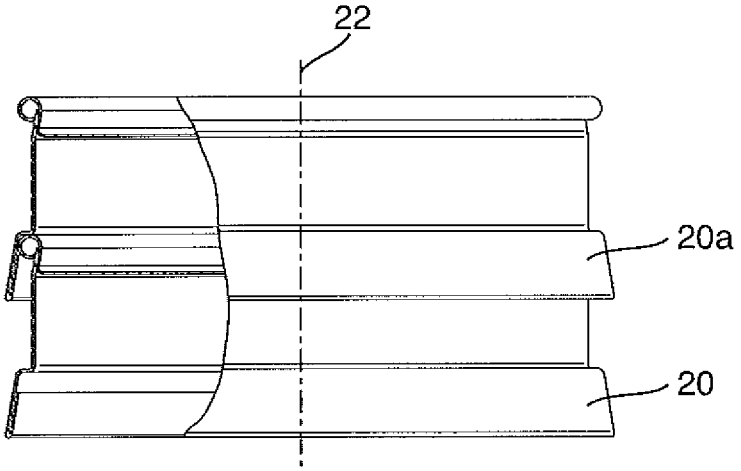
Figure 11A:
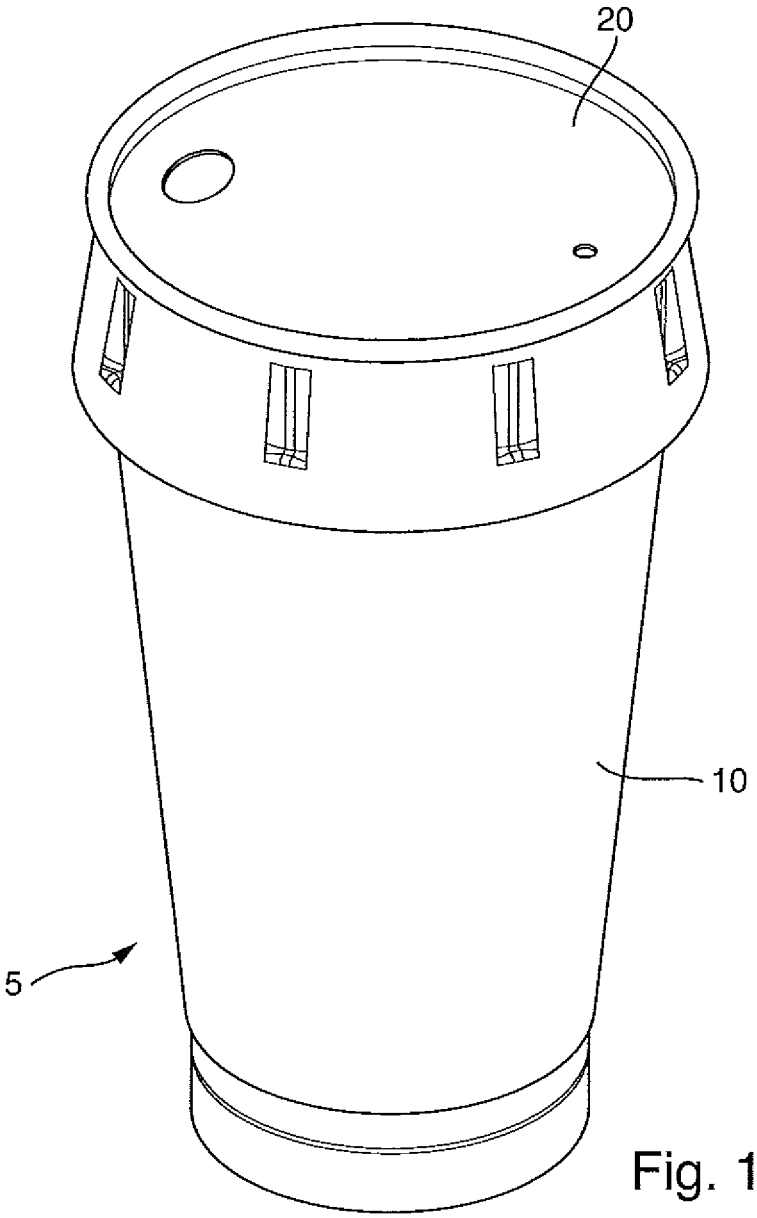
FIGS. 11*a* to 11*d* show a cup assembly having a lid according to an eleventh exemplary embodiment.
Figure 11B:
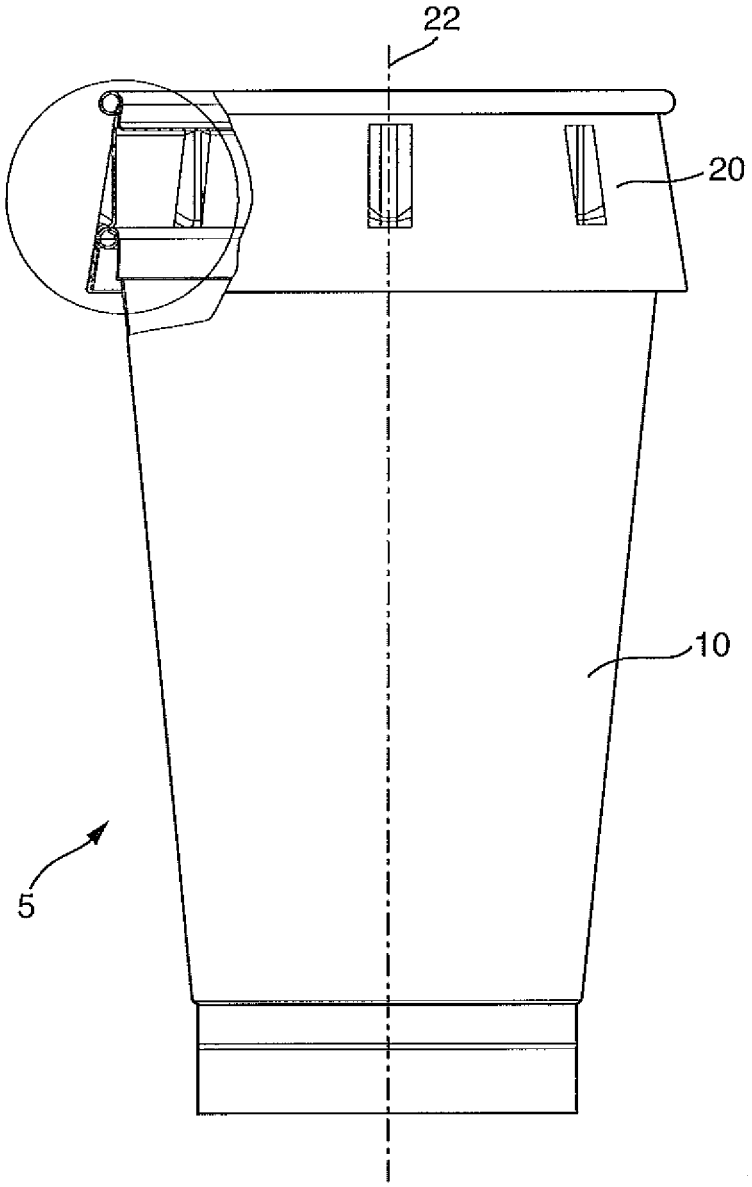
Figure 11C:
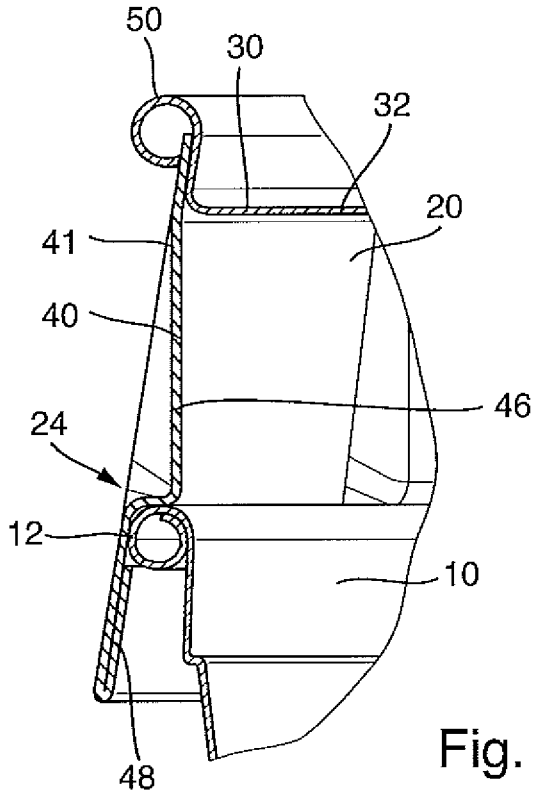
Figure 11D:
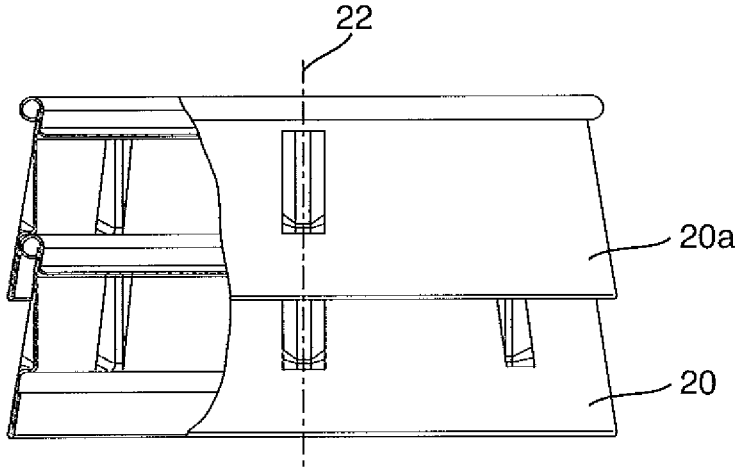

FIG. 10*d* shows two stacked lids 20, 20*a*. The upper lid 20*a* by way of the corrugation 43 thereof bears on the further rolled lip rim 50 of the lower lid 20.

In the lid 20 according to the eleventh exemplary embodiment, which is illustrated in FIGS. 11*a* to 11*d*, the receptacle 24 is configured by indentations 46, as is also the case in the ninth exemplary embodiment. Moreover, a further rolled lip rim 50 is configured, as is also the case in the tenth exemplary embodiment. In terms of the details thereof, reference is made to the corresponding descriptions of the ninth and tenth exemplary embodiments, respectively.

In the lid 20 according to the twelfth exemplary embodiment, which is illustrated in FIGS. 12*a* to 12*d*, the receptacle 24 is configured by an encircling corrugation 43, as in the tenth exemplary embodiment. By contrast to the tenth exemplary embodiment, however, no further rolled lip rim 50 is configured, but the lid-plate element 30 and the wall element 40 are interconnected by means of a border 45, as is also the case in the first exemplary embodiment, for example. By contrast, however, the border 45 in the twelfth exemplary embodiment is inwardly inclined.

Figure 12A:
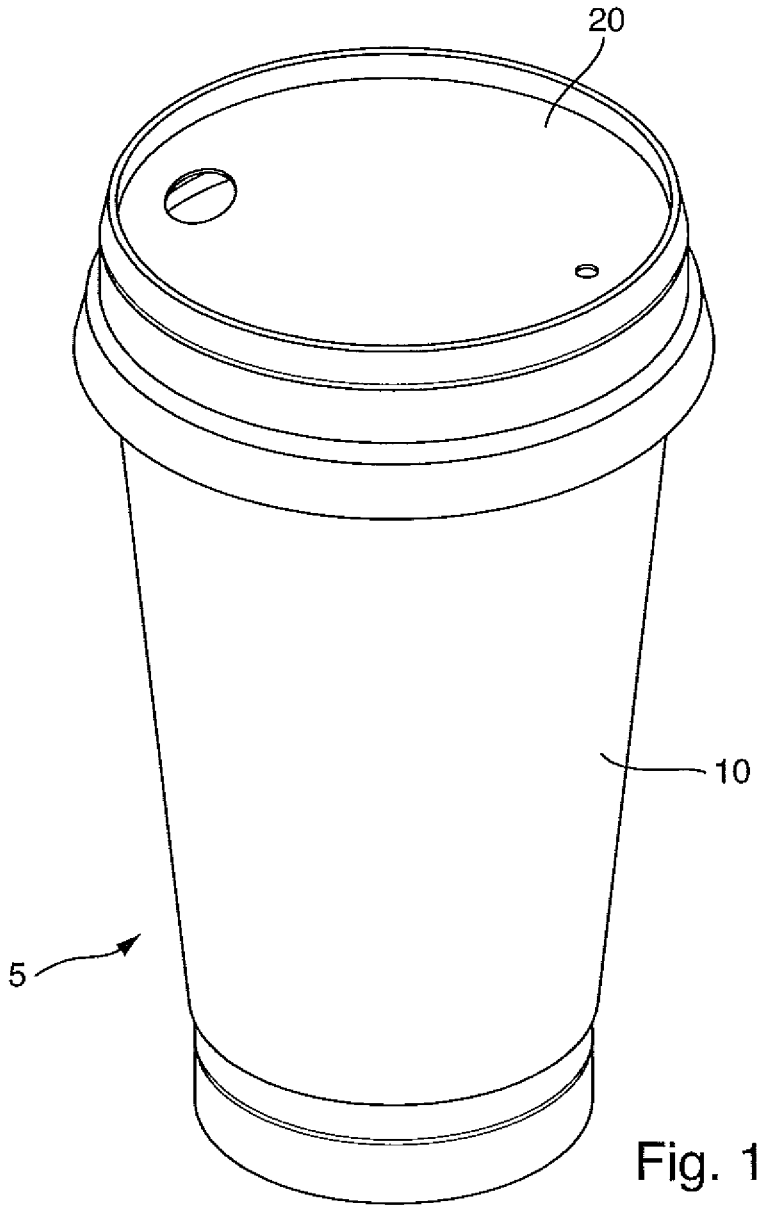
FIGS. 12*a* to 12*d* show a cup assembly having a lid according to a twelfth exemplary embodiment.
Figure 12B:
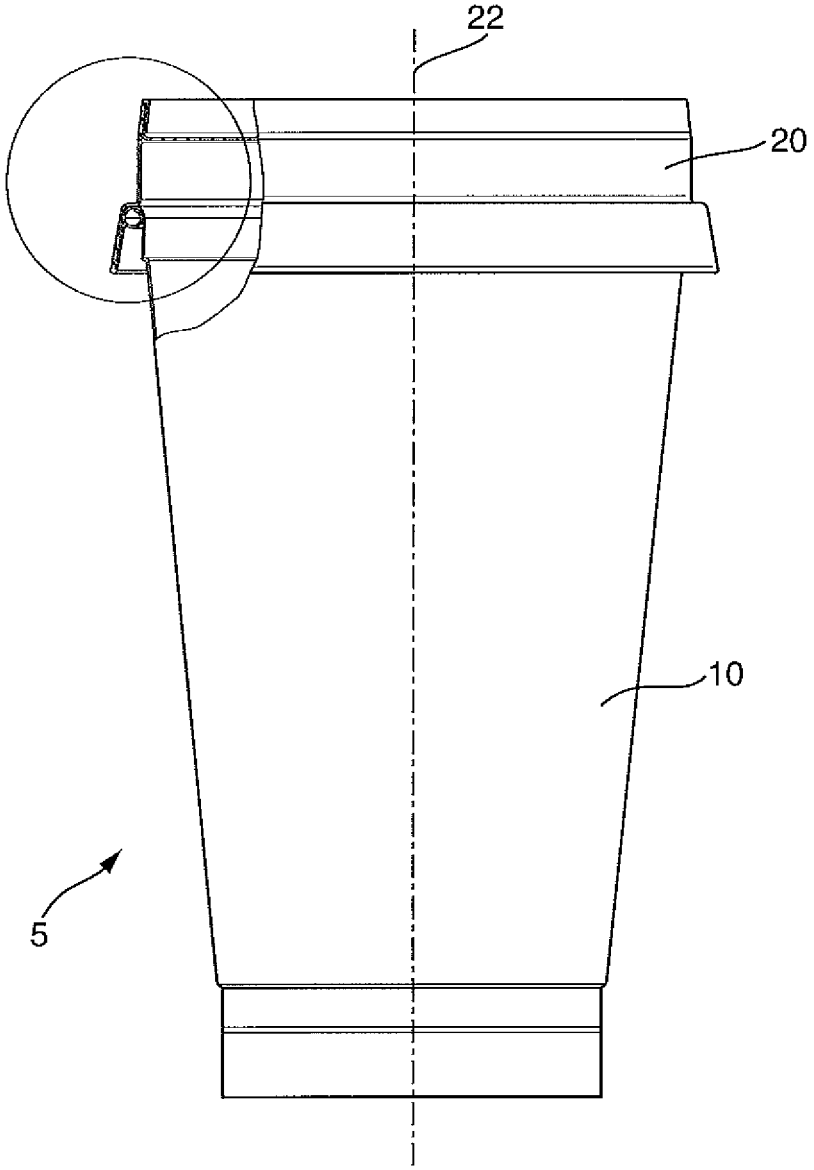
Figure 12C:
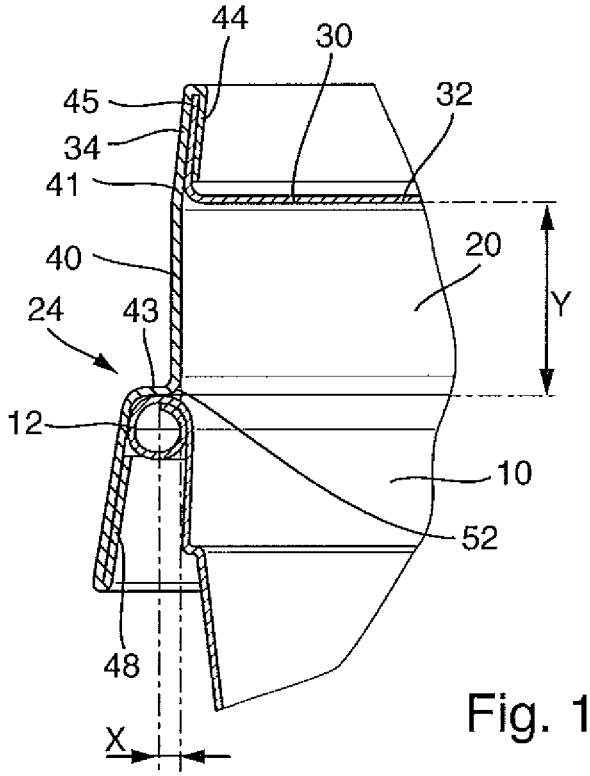

It may be identified in particular in FIG. 12*c* that a part of the receptacle 24 of the lid 20, which sits on the rolled lip rim 12, has a width of about half of the width of the rolled lip rim 12. In this way, advantageous stability may be achieved. Half of the width of the rolled lip rim 12 here is marked by X. Furthermore, the spacing of the lid plate 32 above the rolled lip rim 12 is marked by Y.

Figure 12D:
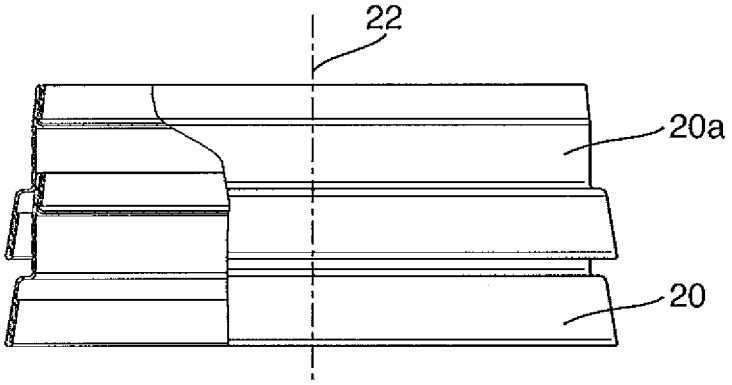

FIG. 12*d* shows two stacked lids 20, 20*a*. A radially inwardly projecting edge 52 of the upper lid 20*a* bears on the outer side 34 of the border 45 of the lower lid 20. Since the outer side 34 is inwardly directed in an oblique manner, the upper lid 20*a* assumes a defined position on the lower lid 20.

Figure 13:
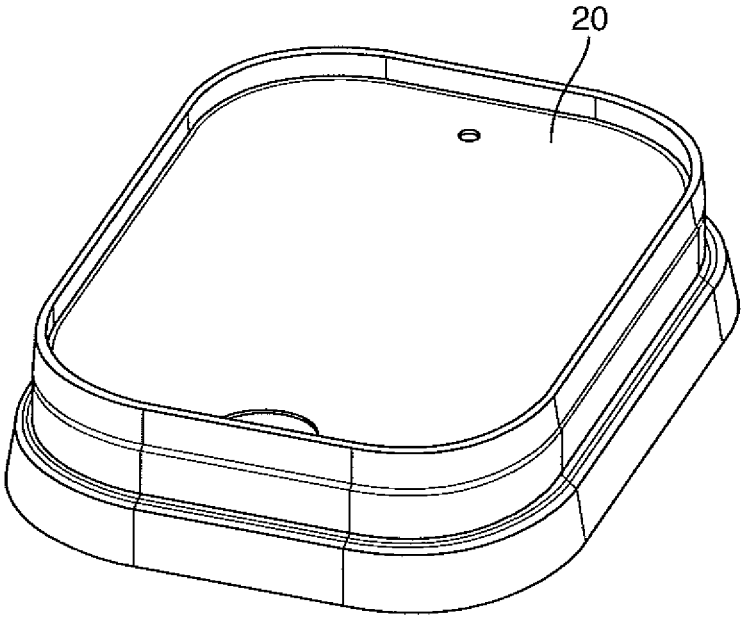
FIG. 13 shows a lid according to a thirteenth exemplary embodiment.

In the thirteenth exemplary embodiment, which is shown in FIG. 13, the lid 20, as opposed to the previous embodiments, is configured so as not to be round but rectangular. The enables adaptation to corresponding rectangular cup shapes.

All exemplary embodiments have in common that the lid plate 32 is arranged above the rolled lip rim 12 of the cup 10, having a significant spacing therefrom. The enables components of beverages which protrude beyond the rolled lip rim 12, for example milk foam in the case of a cappuccino, to be received in the space below the lid plate 32 which is defined by the encircling wall 41.

The invention claimed is:

1. A lid for a beverage cup, made from a paper material or a paper-like material, having a lid-plate element and a wall element;

wherein the lid-plate element includes a lid plate, and the wall element includes an encircling wall;

wherein the lid has a receptacle encircling a central axis, for a rolled lip rim of the beverage cup;

wherein the lid plate and the encircling wall are interconnected in such a manner that the lid plate is kept at a spacing above a first end of the receptacle, the first end of the receptacle being positioned closer to the lid plate than a second end of the receptacle;

wherein the receptacle is configured as a corrugation in the wall element; and wherein the wall element is folded at a lower end thereof such that a folded portion of the wall element is located at an inside of the wall element, the folded portion extending upward through and beyond the corrugation such that the wall element for an entire area of the corrugation is embodied having two layers, the two layers being arranged immediately adjacent each other for an entire area of the corrugation such that the two layers abut each other for the entire area of the corrugation wherein the lip plate is spaced from a top end of the folded portion of the wall element, with the top end of the folded portion of the wall element being located between the corrugation and the lid plate.

2. The lid according to claim 1, wherein the spacing is between 5 mm and 20 mm.

3. The lid according to claim 1, wherein the wall element is inwardly folded below the receptacle, so as to enable latching of the rolled lip rim of the beverage cup by way of a folded portion.

4. The lid according to claim 1, wherein the lid-plate element laterally to the lid plate configures a collar which is upwardly curved and is encompassed by a border of the wall element.

5. The lid according to claim 1, wherein the encircling wall at least outside the receptacle assumes a constant angle in relation to the central axis.

6. A cup assembly, having a beverage cup which has a rolled lip rim, and having the lid according to claim 1, and wherein a part of the receptacle of the lid, which sits on the rolled lip rim, has a width of at least half of the width of the rolled lip rim.

7. A method for manufacturing a lid from a paper material or a paper-like material, according to claim 1, the method comprising the following steps:

providing a lid-plate element;

providing a wall element;

connecting the lid plate to the wall element;

folding the wall element at a lower end thereof such that a folded portion of the wall element is located at an inside of the wall element and forms a corrugation in the wall element, the folded portion extending upward through and beyond the corrugation such that the wall element at least in a region of the corrugation is embodied having two layers.

* * * * *